US010514216B2

(12) United States Patent
Maeda et al.

(10) Patent No.: US 10,514,216 B2
(45) Date of Patent: Dec. 24, 2019

(54) HEAT EXCHANGER

(71) Applicant: Mitsubishi Electric Corporation, Tokyo (JP)

(72) Inventors: Tsuyoshi Maeda, Tokyo (JP); Yuki Ugajin, Tokyo (JP); Akira Ishibashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/775,050

(22) PCT Filed: Jan. 19, 2016

(86) PCT No.: PCT/JP2016/051348
§ 371 (c)(1),
(2) Date: May 10, 2018

(87) PCT Pub. No.: WO2017/126019
PCT Pub. Date: Jul. 27, 2017

(65) Prior Publication Data

US 2018/0372429 A1 Dec. 27, 2018

(51) Int. Cl.
*F28F 17/00* (2006.01)
*F28D 1/053* (2006.01)
(Continued)

(52) U.S. Cl.
CPC ..... *F28F 17/005* (2013.01); *F28D 1/05383* (2013.01); *F28F 1/325* (2013.01);
(Continued)

(58) Field of Classification Search
CPC ..... F28F 17/005; F28F 2210/10; F28F 1/325; F28D 1/05383; F28D 1/05391; F28D 2021/0071; F28D 1/0246
See application file for complete search history.

(56) References Cited

U.S. PATENT DOCUMENTS 7,549,465 B2 * 6/2009 Gong ..... F28F 9/02 165/150
2007/0246206 A1 10/2007 Gong et al.
(Continued)

FOREIGN PATENT DOCUMENTS

CN 1216364 A 5/1999
DE 90 14 655 U1 2/1991
(Continued)

OTHER PUBLICATIONS

Extended European Search Report dated Dec. 10, 2018 issued in corresponding European patent application No. 16886262.1.
(Continued)

*Primary Examiner* — Jon T. Schermerhorn, Jr.
(74) *Attorney, Agent, or Firm* — Posz Law Group, PLC

(57) ABSTRACT

A heat exchanger includes: a first heat transfer portion including a plurality of first flat tubes arranged at equal intervals and spaced apart from each other by a distance Dp in a gravity direction; and a second heat transfer portion positioned downstream of the first heat transfer portion in a flow direction of a heat exchange medium perpendicular to the gravity direction, the second heat transfer portion including a plurality of second flat tubes arranged at equal intervals and spaced apart from each other by the distance Dp in the gravity direction.

10 Claims, 10 Drawing Sheets

(51) Int. Cl.
*F28F 1/32* (2006.01)
*F28D 21/00* (2006.01)

(52) U.S. Cl.
CPC .. *F28D 1/05391* (2013.01); *F28D 2021/0071* (2013.01); *F28F 2210/10* (2013.01); *F28F 2215/12* (2013.01)

(56) References Cited

U.S. PATENT DOCUMENTS

| | | | | |
|---|---|---|---|---|
| 2010/0116481 | A1* | 5/2010 | Evans | F28D 1/0391 165/173 |
| 2019/0049185 | A1* | 2/2019 | Ito | F28D 1/0246 |

FOREIGN PATENT DOCUMENTS

| | | | | |
|---|---|---|---|---|
| JP | S49-150462 | U | 12/1974 | |
| JP | S62-166476 | U | 10/1987 | |
| JP | S63-003183 | A | 1/1988 | |
| JP | S633183 | B2 * | 1/1988 | F16H 61/0021 |
| JP | H11-141904 | A | 5/1999 | |
| JP | 2000-028288 | A | 1/2000 | |
| JP | 2000-337781 | A | 12/2000 | |
| JP | 2007-183088 | A | 7/2007 | |
| JP | 2008-002746 | A | 1/2008 | |
| JP | 2012-037154 | A | 2/2012 | |

OTHER PUBLICATIONS

International Search Report of the International Searching Authority dated Apr. 12, 2016 for the corresponding international application No. PCT/JP2016/051348 (and English translation).
Office Action dated May 8, 2019 issued in corresponding CN patent application No. 201680078569.7 (and English translation).
Office Action dated May 21, 2019 issued in corresponding JP patent application No. 2017-562187 (and English translation).
Office Action dated Sep. 12, 2019 issued in corresponding CN patent application No. 201680078569.7 (and English translation).

* cited by examiner

HEAT EXCHANGER

CROSS REFERENCE TO RELATED APPLICATION

This application is a U.S. national stage application of International Application No. PCT/JP2016/051348, filed on Jan. 19, 2016, the contents of which are incorporated herein by reference.

TECHNICAL FIELD

The present invention relates to a heat exchanger including a flat tube.

BACKGROUND

Hitherto, there has been known a fin-and-tube heat exchanger including a plurality of plate-shaped fins, which are arranged at predetermined fin pitch intervals and extend in the gravity direction, and a plurality of heat transfer tubes (hereinafter referred to as "flat tubes"), which each have a flat cross-sectional shape. Each flat tube is joined to the fins, for example, by brazing, and extends in a horizontal direction so as to cross the fins. An end portion of each flat tube is connected to, for example, a distributor or a header which forms a refrigerant flow passage together with the flat tubes. In the heat exchanger, heat is exchanged between heat exchange fluid such as air which flows through the fins and heat-exchanged fluid such as water or refrigerant which flows in the flat tubes.

In a heat exchanger using flat tubes as heat transfer tubes, as compared to a heat exchanger using circular tubes, a larger heat transfer area can be secured in a tube, and flow resistance of the heat exchange fluid can be suppressed, thereby enabling improvement in heat transfer performance. Meanwhile, with regard to drainage performance of the heat exchanger, the cross-sectional shape of the flat tube is liable to cause water droplets to remain on a tube surface of the flat tube, and hence drainage performance of the flat tube tends to be lower than that of the circular tube.

For example, during a heating operation of an air conditioner, moisture contained in air being the heat exchange fluid is condensed to adhere to a heat exchanger of an outdoor unit, with the result that frost is formed. In general, a defrosting mode is provided for the purpose of preventing increase in flow resistance and degradation in heat transfer performance as well as damage to the heat exchanger due to frost formation. However, when water droplets remain, the water droplets are frozen again and grow into larger frost. Thus, when the drainage performance is low, it is required to extend a time period of an operation in the defrosting mode. As a result, degradation in comfortability or degradation in average heating performance may occur.

In view of the above-mentioned circumstances, in Patent Literature 1, there is disclosed a heat exchanger in which flat tubes are inclined in the gravity direction for the purpose of improving the drainage performance (see Patent Literature 1).

PATENT LITERATURE

Patent Literature 1: Japanese Unexamined Patent Application Publication No. 2007-183088

In the heat exchanger disclosed in Patent Literature 1, among flat tubes which are arranged in two rows along a flow direction of heat exchange fluid (for example, air), the flat tubes in a first row are inclined downward to a leeward side, and are arranged in a staggered manner. The flat tubes are arranged in the staggered manner for the purpose of improving the heat transfer performance by causing the heat exchange fluid having passed through the first row to hit the flat tubes in the second row and thereby increasing a flow rate along heat transfer surfaces of the flat tubes in the second row.

When the heat transfer tubes are circular tubes, or the flat tubes are not inclined, a main flow direction of the heat exchange fluid which passes through the heat transfer tubes in the first row substantially matches a plane passing through a center between the heat transfer tubes in the first row. Thus, with the general staggered arrangement of arranging the heat transfer tubes in the second row on the plane passing through the center between the heat transfer tubes in the first row, the heat transfer performance can be improved.

However, in the heat exchanger disclosed in Patent Literature 1, the flat tubes in the first row are inclined, and hence separation of the heat exchange fluid occurs at front edges of the tubes in the first row. As a result, the main flow direction of the heat exchange fluid which flows into the flat tubes in the second row deviates from the inclination direction of the flat tubes in the first row, and thus separates from the plane passing through the center between the heat transfer tubes in the first row. Due to occurrence of such a phenomenon, there has been a problem in that, with the general staggered arrangement, heat exchange cannot be effectively performed at the heat transfer tubes in the second row, with the result that the heat transfer performance cannot be improved.

SUMMARY

The present invention has been made to solve the problem described above, and has an object to provide a heat exchanger which is capable of improving the drainage performance in the flat tubes and securing the heat transfer performance.

According to one embodiment of the present invention, there is provided a heat exchanger, including: a first heat transfer portion including a plurality of first flat tubes arranged at equal intervals and spaced apart from each other by a distance Dp in a gravity direction; and a second heat transfer portion positioned downstream of the first heat transfer portion in a flow direction of a heat exchange medium perpendicular to a gravity direction, the second heat transfer portion including a plurality of second flat tubes arranged at equal intervals and spaced apart from each other by the distance Dp in a gravity direction, wherein the plurality of first flat tubes are each arranged with inclination such that an angle formed between a first cross-sectional center plane and the flow direction is an angle θ1, the first cross-sectional center plane being an imaginary plane passing through the center of a direction of short-axis of a flow passage cross section, and that a front edge portion in the flow direction is below a rear edge portion in the flow direction, wherein the plurality of second flat tubes each have a front-most edge line being an intersecting line between a second cross-sectional center plane and an end portion on upstream in the flow direction, the second cross-sectional center plane being an imaginary plane passing through the center of a direction of short-axis of a flow passage cross section, wherein adjacent ones of the front-most edge lines include a first front-most edge line positioned on an upper side in the gravity direction and a second front-most edge line positioned on a lower side in the gravity direction, wherein the first front-most edge line and the first cross-sectional center plane positioned between the first front-most edge line and the second front-most edge line are arranged to be spaced apart from each other by a distance W, wherein the distance W satisfies the following formula:

$$W=\xi\times Dp\times\cos\theta 1 \text{ where } 0\leq\xi<0.5.$$

According to one embodiment of the present invention, there is provided a heat exchanger, including: a first heat transfer portion including a plurality of first flat tubes arranged at equal intervals and spaced apart from each other by a distance Dp in a gravity direction; and a second heat transfer portion positioned downstream of the first heat transfer portion in a flow direction of a heat exchange medium perpendicular to the gravity direction, the second heat transfer portion including a plurality of second flat tubes arranged at equal intervals and spaced apart from each other by the distance Dp in the gravity direction, in which the plurality of first flat tubes are each arranged with inclination such that an angle formed between a first cross-sectional center plane and the flow direction is an angle θ1, the first cross-sectional center plane being an imaginary plane passing through the center of a direction of short-axis of a flow passage cross section, and that a front edge portion in the flow direction is above a rear edge portion in the flow direction; the plurality of second flat tubes each have a front-most edge line being an intersecting line between a second cross-sectional center plane and an end portion on upstream in the flow direction, the second cross-sectional center plane being an imaginary plane passing through the center of a direction of short-axis of a flow passage cross section; adjacent ones of the front-most edge lines include a first front-most edge line positioned on an upper side in the gravity direction and a second front-most edge line positioned on a lower side in the gravity direction; the second front-most edge line and the first cross-sectional center plane, which is positioned between the first front-most edge line and the second front-most edge line are arranged to be spaced apart from each other by a distance W; and the distance W is set so as to satisfy $W=\xi\times Dp\times\cos\theta 1$ where $0\leq\xi<0.5$.

According to one embodiment of the present invention, it is possible to obtain a heat exchanger which is capable of improving the drainage performance in the flat tubes and securing the heat transfer performance.

DETAILED DESCRIPTION

Figure 1:
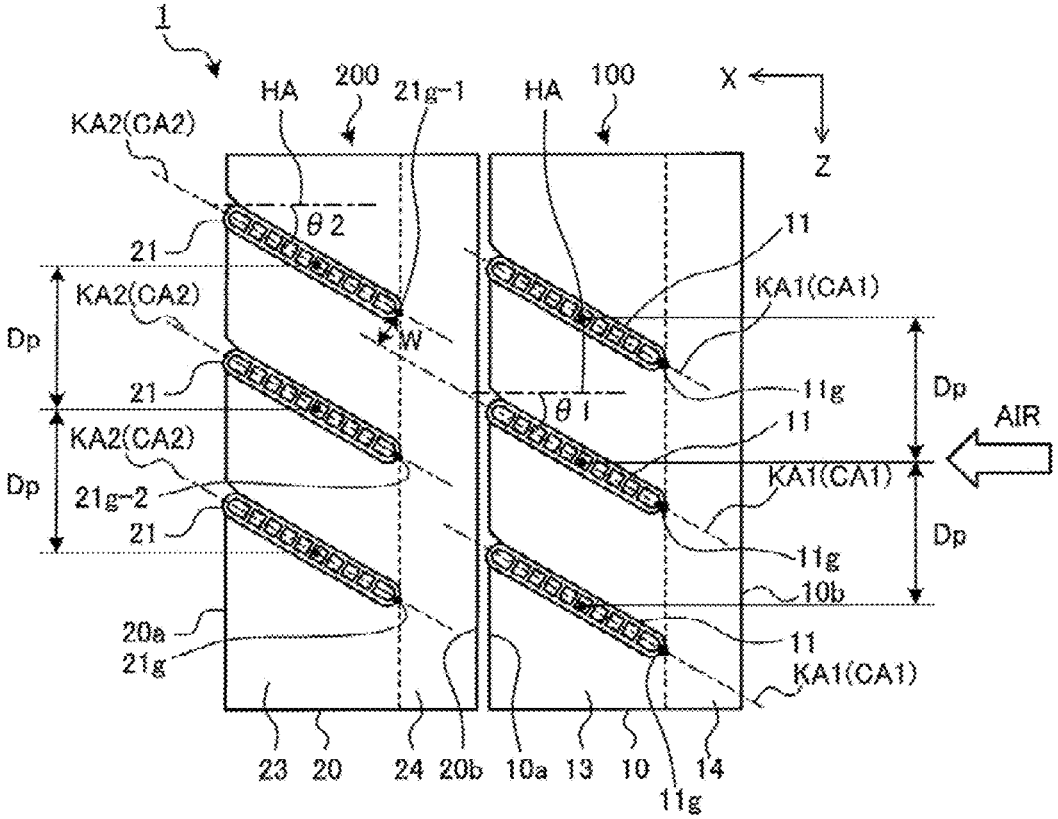
FIG. 1 is a front view for illustrating a heat exchanger 1 according to Embodiment 1 of the present invention.

Now, a heat exchanger according to the present invention is described with reference to the drawings.

A configuration of an outdoor unit described below is merely an example, and the heat exchanger according to the present invention is not limited to such configuration. Further, for the same or similar components in the drawings, the components are denoted by the same reference symbols, or reference symbols are omitted. Further, with regard to detailed structures, illustration is suitably simplified or omitted. Further, overlapping or similar description is suitably simplified or omitted.

Embodiment 1

FIG. 1 is a front view for illustrating a heat exchanger 1 according to Embodiment 1 of the present invention.

Figure 2:
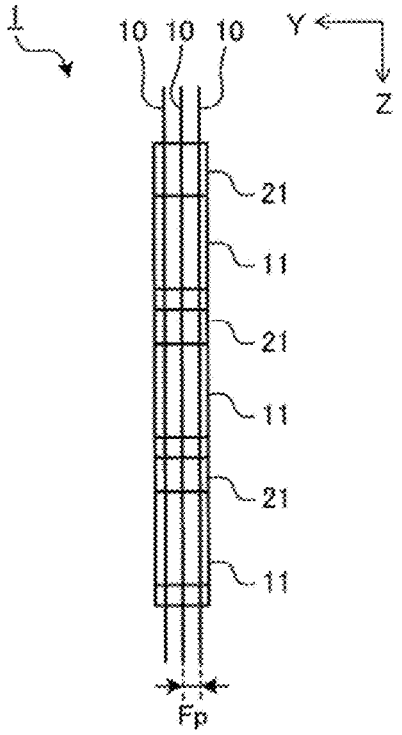
FIG. 2 is a side view for illustrating the heat exchanger 1 according to Embodiment 1.

FIG. 2 is a side view for illustrating the heat exchanger 1 according to Embodiment 1.

Figure 3:
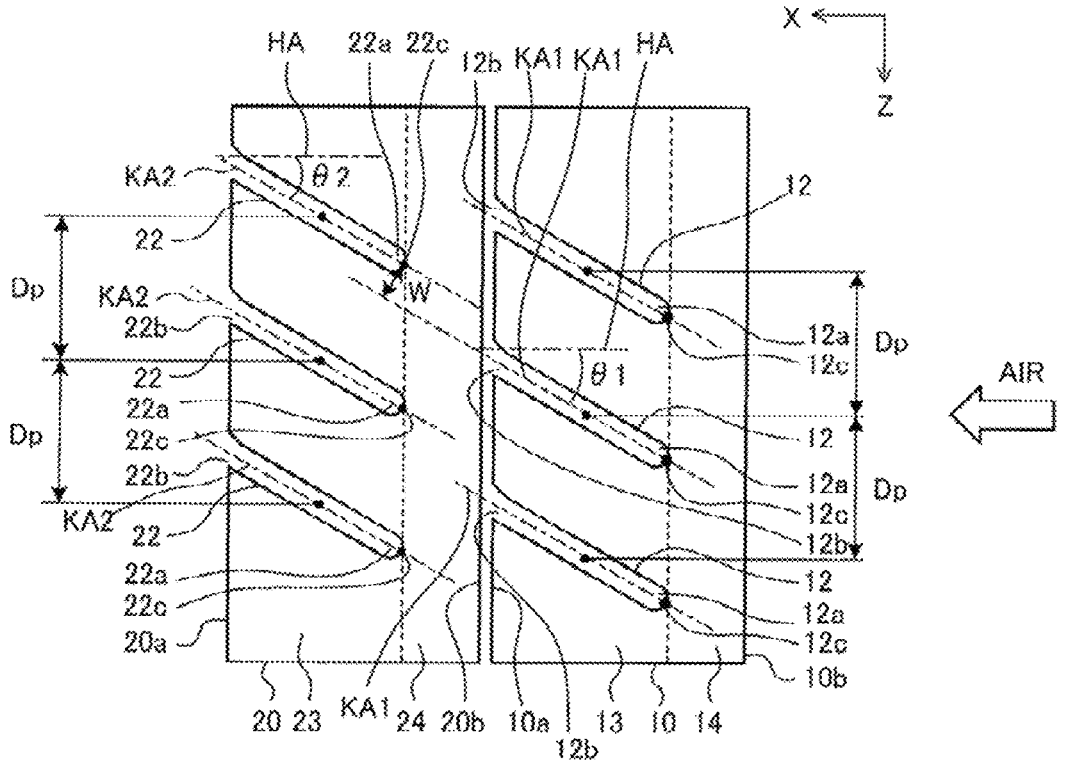
FIG. 3 is a front view for illustrating a first fin 10 and a second fin 20 in Embodiment 1.

FIG. 3 is a front view for illustrating a first fin 10 and the second fin 20 in Embodiment 1.

Figure 4:
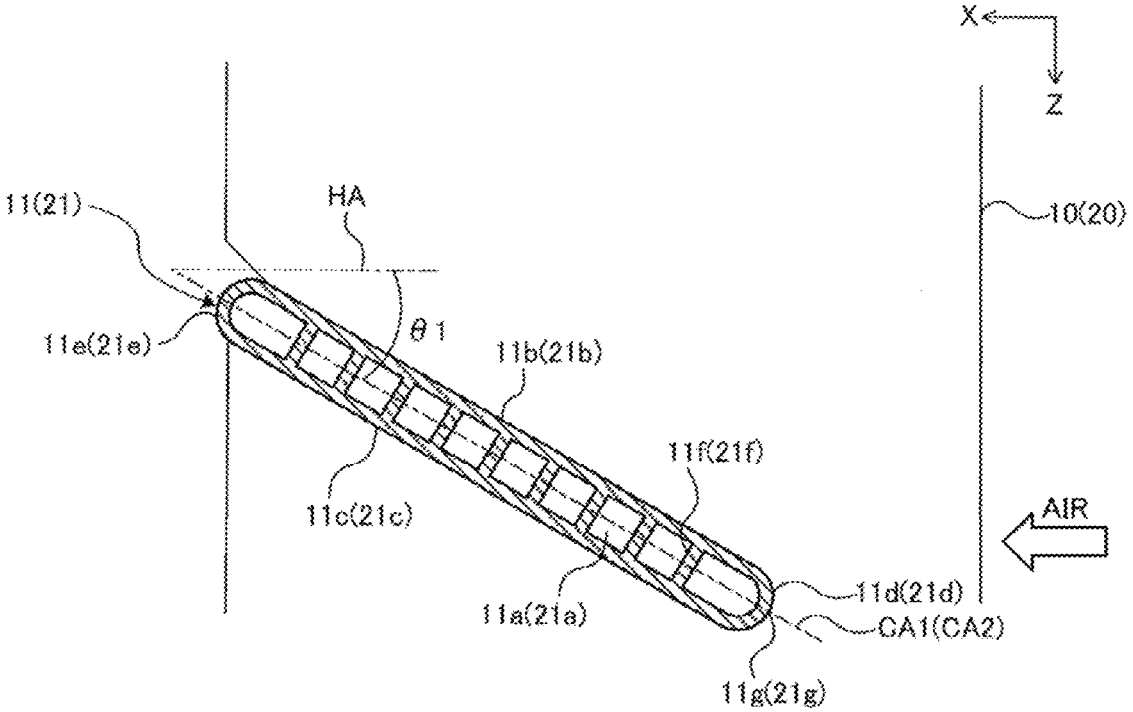
FIG. 4 is a sectional view of a first flat tube 11 (second flat tube 21) mounted to the first fin 10 (second fin 20) in Embodiment 1.

FIG. 4 is a sectional view of a first flat tube 11 (second flat tube 21) mounted to the first fin 10 (second fin 20) in Embodiment 1.

With reference to FIG. 1 to FIG. 4, the heat exchanger 1 is described below.

The heat exchanger 1 includes a first heat transfer portion 100 and a second heat transfer portion 200. The first heat transfer portion 100 is arranged upstream of the second heat transfer portion 200 in a flow direction (X-axis direction) of air being heat exchange fluid.

<Configuration of First Heat Transfer Portion 100>

The first heat transfer portion 100 includes a plurality of first fins 10 and a plurality of first flat tubes 11. The plurality of first fins 10 are each formed into a plate shape extending in a gravity direction (Z-axis direction). The plurality of first fins 10 are perpendicular to the flow direction (X-axis direction) of air, and are arranged at predetermined fin pitches Fp in a direction (Y-axis direction) perpendicular to the gravity direction (Z-axis direction). The plurality of first flat tubes 11 extend in the Y-axis direction, and are arranged so as to cross the plurality of first fins 10. The plurality of first fins 10 and the plurality of first flat tubes 11 are integrally joined to each other by brazing. The first fins 10 are made of, for example, aluminum or aluminum alloy.

As illustrated in FIG. 1 and FIG. 3, the first fin 10 has a cutout region 13 and a drainage region 14.

The cutout region 13 is a region in which a plurality of first cutout portions 12 are formed along a longitudinal direction being the gravity direction (Z-axis direction). As illustrated in FIG. 3, the first cutout portions 12 of the first fin 10 are each cut out so as to extend from a one-side portion 10*a* side toward an another-side portion 10*b* of the first fin 10, and are each formed into an elongated shape conforming to an outer shape of the first flat tube 11. The plurality of first cutout portions 12 are formed to be parallel to each other and have the same shape. The first flat tubes 11 are inserted into the first cutout portions 12 and joined by brazing.

The drainage region 14 is a region in which no first cutout portion 12 is formed along the longitudinal direction (Z-axis direction), and the first fin 10 is formed continuously. The drainage region 14 is a region in which water having adhered to the first fin 10 is discharged in the gravity direction. The drainage region 14 is arranged upstream of the cutout region 13 (another-side portion 10*b* side of the first fin 10) of the cutout region 13 in the flow direction (X-axis direction) of air being the heat exchange fluid.

In each of the first cutout portions 12, depth-side portions 12*a* on the other side portion 10*b* side of the first fin 10 is formed into a semi-circular shape in conformity with a shape of the first flat tube 11. The depth-side portions 12*a* in the first cutout portions 12 may each be formed into an elliptical shape.

A straight line which extends in the gravity direction (Z-axis direction) and passes end portions of the depth-side portions 12*a* in the first cutout portions 12 is a boundary line between the cutout region 13 and the drainage region 14.

The first cutout portion 12 has an insertion portion 12*b* on the one-side portion 10*a* side of the first fin 10. The insertion portion 12*b* is expanded in a width direction of the first cutout portion 12. Such a shape of the insertion portion 12*b* facilitates an operation of inserting the first flat tube 11 into the first cutout portion 12.

The depth-side portion 12*a* side of the first cutout portion 12 is positioned below the insertion portion 12*b* side of the first cutout portion 12 in the gravity direction (Z-axis direction). As illustrated in FIG. 3, the first cutout portion 12 is formed with inclination such that an angle formed between a cutout center plane KA1, which is an imaginary center plane of the first cutout portion 12 in a short-length direction (width direction), and a horizontal plane HA is a predetermined inclination angle θ1. Further, a distance between first cutout portions 12, which are vertically adjacent to each other, in the gravity direction (Z-axis direction) is constant at a stage pitch (distance) Dp as illustrated in FIG. 3. An intersecting point between the depth-side portion 12*a* of the first cutout portion 12 and the cutout center plane KA1 is set as a deepest point 12*c*.

As illustrated in FIG. 1, the plurality of first flat tubes 11 are mounted to the plurality of first cutout portions 12 of the first fin 10 so as to intersect with the first fin 10. As illustrated in FIG. 4, a cross-sectional shape of an outer shell of the first flat tube 11 includes a pair of a first surface portion 11*b* and a second surface portion 11*c* facing each other, and includes a first arcuate portion 11*d* and a second arcuate portion 11*e* at both end portions. Further, on an inner side of the surfaces forming the outer shell, a plurality of refrigerant flow passages 11*a* which are partitioned by partition walls 11*f* are formed. The cross-sectional shape of the outer shell of the first flat tube 11 may be a substantially elliptical cross-sectional shape.

A wall surface of the refrigerant flow passage 11*a*, that is, an inner wall surface of the first flat tube 11 may have a groove. With such a groove, a contact area between the inner wall surface of the first flat tube 11 and refrigerant increases, and thus the heat transfer performance improves. The first flat tube 11 is made of, for example, aluminum or aluminum alloy.

Under a state in which the first flat tube 11 is mounted to the first cutout portion 12, the first arcuate portion 11*d* side of the first flat tube 11 (which corresponds to a front edge portion of the present invention provided upstream in the flow direction (X-axis direction) of air being the heat exchange fluid) is positioned below the second arcuate portion 11*e* side (which corresponds to a rear edge portion of the present invention on downstream in the flow direction (X-axis direction) of air being the heat exchange fluid) in the gravity direction (Z-axis direction). Further, as described above, the first flat tube 11 is fixed to the first cutout portion 12. Therefore, a first cross-sectional center plane CA1, which is an imaginary plane passing through the center of a direction of short-axis in a flow passage cross section of the first flat tube 11 (direction perpendicular to the first surface portion 11*b* and the second surface portion 11*c*), and the cutout center plane KA1 are in flush with each other. Accordingly, the first flat tube 11 is arranged with inclination such that an angle formed between the first cross-section center plane CA1 of the first flat tube 11 and the horizontal plane HA is the predetermined inclination angle θ1. A distance between first flat tubes 11, which are vertically adjacent to each other, in the gravity direction (Z-axis direction) is constant at the stage pitch (distance) Dp.

Further, an intersecting line between the first arcuate portion 11*d* and the first cross-sectional center plane CA1 is set as a front-most edge line 11*g* of the first flat tube 11. Accordingly, the deepest point 12*c* of the first cutout portion 12 and the front-most edge line 11*g* of the first flat tube 11 are located at the same position and brought into contact with each other.

<Configuration of Second Heat Transfer Portion 200>

The second heat transfer portion 200 includes a plurality of second fins 20 and a plurality of second flat tubes 21. The plurality of second fins 20 are each formed into a plate shape extending in the gravity direction (Z-axis direction). The plurality of second fins 20 are perpendicular to the flow direction (X-axis direction) of air, and are arranged at the predetermined fin pitches Fp in the direction (Y-axis direction) perpendicular to the gravity direction (Z-axis direction). The plurality of second flat tubes 21 extend in the Y-axis direction, and are arranged so as to cross the plurality of second fins 20. The plurality of second fins 20 and the plurality of second flat tubes 21 are integrally joined to each other by brazing. The second fins 20 are made of, for example, aluminum or aluminum alloy.

As illustrated in FIG. 1 and FIG. 3, the second fin 20 has a cutout region 23 and a drainage region 24.

The cutout region 23 is a region in which a plurality of second cutout portions 22 are formed along a longitudinal direction being the gravity direction (Z-axis direction). As illustrated in FIG. 3, the second cutout portions 22 of the second fin 20 are each cut out so as to extend from a one-side portion 20*a* side toward an another-side portion 20*b* side of the second fin 20, and are each formed into an elongated shape conforming to an outer shape of the second flat tube 21. The plurality of second cutout portions 22 are formed to be parallel to each other and have the same shape. The second flat tubes 21 are inserted into the second cutout portions 22 and joined by brazing.

The drainage region 24 is a region in which no second cutout portion 22 is formed along the longitudinal direction (Z-axis direction), and the second fin 20 is formed continuously. The drainage region 24 is a region in which water having adhered to the second fin 20 is discharged in the gravity direction. The drainage region 24 is arranged upstream of the cutout region 23 (another-side portion 20*b* side of the first fin 10) of the cutout region 23 in the flow direction (X-axis direction) of air being the heat exchange fluid.

In each of the second cutout portions 22, a depth-side portion 22*a* on the other side portion 10*b* side of the second fin 20 is formed into a semi-circular shape in conformity with a shape of the second flat tube 21. The depth-side portions 22*a* in the second cutout portions 22 may each be formed into an elliptical shape.

A straight line which extends in the gravity direction (Z-axis direction) and passes end portions of the depth-side portions 22*a* in the second cutout portions 22 is a boundary line between the cutout region 23 and the drainage region 24.

The second cutout portion 22 has an insertion portion 22*b* on the one-side portion 20*a* side of the second fin 20. The insertion portion 22*b* is expanded in a width direction of the second cutout portion 22. Such a shape of the insertion portion 22*b* facilitates an operation of inserting the second flat tube 21 into the second cutout portion 22.

The depth-side portion 22*a* side of the second cutout portion 22 is positioned below the insertion portion 22*b* side of the second cutout portion 22 in the gravity direction (Z-axis direction). As illustrated in FIG. 3, the second cutout portion 22 is formed with inclination such that an angle formed between a cutout center plane KA2, which is an imaginary center plane of the second cutout portion 22 in a short-length direction (width direction), and the horizontal plane HA is a predetermined inclination angle θ2. Further, a distance between second cutout portions 22, which are vertically adjacent to each other, in the gravity direction (Z-axis direction) is constant at a stage pitch (distance) Dp as illustrated in FIG. 3. An intersecting point between the depth-side portion 22*a* of the second cutout portion 22 and the cutout center plane KA1 is set as a deepest point 22*c*.

As illustrated in FIG. 1, the plurality of second flat tubes 21 are mounted to the plurality of second cutout portions 22 of the second fin 20 so as to intersect with the second fin 20. As illustrated in FIG. 4, a cross-sectional shape of an outer shell of the second flat tube 21 includes a pair of a first surface portion 21*b* and a second surface portion 21*c* facing each other, and includes a first arcuate portion 21*d* and a second arcuate portion 21*e* at both end portions. Further, on an inner side of the surfaces forming the outer shell, a plurality of refrigerant flow passages 21*a* which are partitioned by partition walls 21*f* are formed. The cross-sectional shape of the outer shell of the second flat tube 21 may be a substantially elliptical cross-sectional shape.

A wall surface of the refrigerant flow passage 21*a*, that is, an inner wall surface of the second flat tube 21 wall surface may have a groove. With such a groove, a contact area between the inner wall surface of the second flat tube 21 and refrigerant increases, and thus the heat transfer performance improves. The second flat tube 21 is made of, for example, aluminum or aluminum alloy.

Under a state in which the second flat tube 21 is mounted to the second cutout portion 22, the first arcuate portion 21*d* side of the second flat tube 21 (which corresponds to an upper edge portion provided upstream in the flow direction (X-axis direction) of air being the heat exchange fluid) is positioned below the second arcuate portion 21*e* side (which corresponds to a lower edge portion on downstream in the flow direction (X-axis direction) of air being the heat exchange fluid) in the gravity direction (Z-axis direction). Further, as described above, the second flat tube 21 is fixed to the second cutout portion 22. Therefore, a second cross-sectional center plane CA2 being a virtual center plane in a short-axis direction in a flow passage cross section of the second flat tube 21 (direction perpendicular to the first surface portion 21*b* and the second surface portion 21*c*) and the cutout center plane KA2 are in flush with each other. Accordingly, the second flat tube 21 is arranged with inclination such that an angle formed between the second cross-sectional center plane CA2 being a virtual center plane of the second flat tube 21 and the horizontal plane HA is the predetermined inclination angle θ2.

The inclination angle θ1 and the inclination angle θ2 in Embodiment 1 are equal to each other. Further, a distance between second flat tubes 21, which are vertically adjacent to each other, in the gravity direction (Z-axis direction) is constant at the stage pitch (distance) Dp.

Further, an intersecting line between the first arcuate portion 21*d* and the second cross-sectional center plane CA2 is set as a front-most edge line 21*g* of the second flat tube 21. Accordingly, the deepest point 22*c* of the second cutout portion 22 and the front-most edge line 21*g* of the second flat tube 21 are located at the same position and brought into contact with each other.

<Positional Relationship of First Flat Tubes 11 and Second Flat Tubes 21>

Description is made of a positional relationship of cutout center planes KA2 of a pair of second cutout portions 22, which are vertically adjacent to each other in the gravity direction (Z-axis direction), and the cutout center plane KA1 of the first cutout portion 12 which is positioned between the pair of cutout center planes KA2.

As illustrated in FIG. 1 and FIG. 3, a distance between the cutout center plane KA2, which is one of the pair of second cutout portions 22 positioned on an upper side in the gravity direction (Z-axis direction), and the cutout center plane KA1 of the first cutout portion 12 positioned between the pair of cutout center planes KA2 is defined as a distance W. In the heat exchanger 1 of Embodiment 1, the distance W as a function of the stage pitch (distance) Dp is expressed with $W=\xi\times Dp\times\cos\theta 1$. An eccentricity ξ is a coefficient which falls within a range of $0\leq\xi<0.5$. With such a configuration of the first cutout portions 12 and the second cutout portions 22, a positional relationship of the first flat tubes 11 and the second flat tubes 21 which are inserted into respective cutout portions is determined.

That is, when the first flat tube 11 and the second flat tube 21 are fixed to the first cutout portion 12 and the second cutout portion 22, respectively, the plurality of first flat tubes 11 are arranged so that the angle θ1 is formed between the first cross-sectional center plane CA1 being the imaginary plane passing through the center of the direction of short-axis of the flow passage cross section and the flow direction (X-axis direction) of air. The plurality of second flat tubes 21 are arranged so that the angle θ2 is formed between the second cross-sectional center plane CA2 being the imaginary plane passing through the center of the direction of short-axis of the flow passage cross section and the flow direction (X-axis direction) of air.

Further, the first flat tube 11 and the second flat tube 21 are arranged with inclination such that the front edge portions thereof (first arcuate portions 11*d* and 21*d*) in the flow direction (X-axis direction) of air are below the rear edge portions thereof (second arcuate portions 11*e* and 21*e*).

Further, the plurality of second flat tubes 21 each have the front-most edge line 21*g* provided upstream in the flow direction, and a pair of front-most edge lines 21*g* adjacent to each other in the gravity direction (Z-axis direction) have a first front-most edge line 21*g*−1 positioned on an upper side in the gravity direction and a second front-most edge line 21*g*−2 positioned on a lower side in the gravity direction. Accordingly, the first front-most edge line 21*g*−1 and the first cross-sectional center plane CA1 of the first flat tube 11, which is positioned between the first front-most edge line 21*g*−1 and the second front-most edge line 21*g*−2, are arranged to be spaced apart from each other by the distance W. In this case, the distance W is a dimension which satisfies $W=\xi\times Dp\times\cos\theta1$ where $0\leq\xi<0.5$.

<Actions of Arrangement of First Flat Tubes 11 and Second Flat Tubes 21>

Description is made of actions of the heat exchanger 1 of Embodiment 1.

Figure 5:
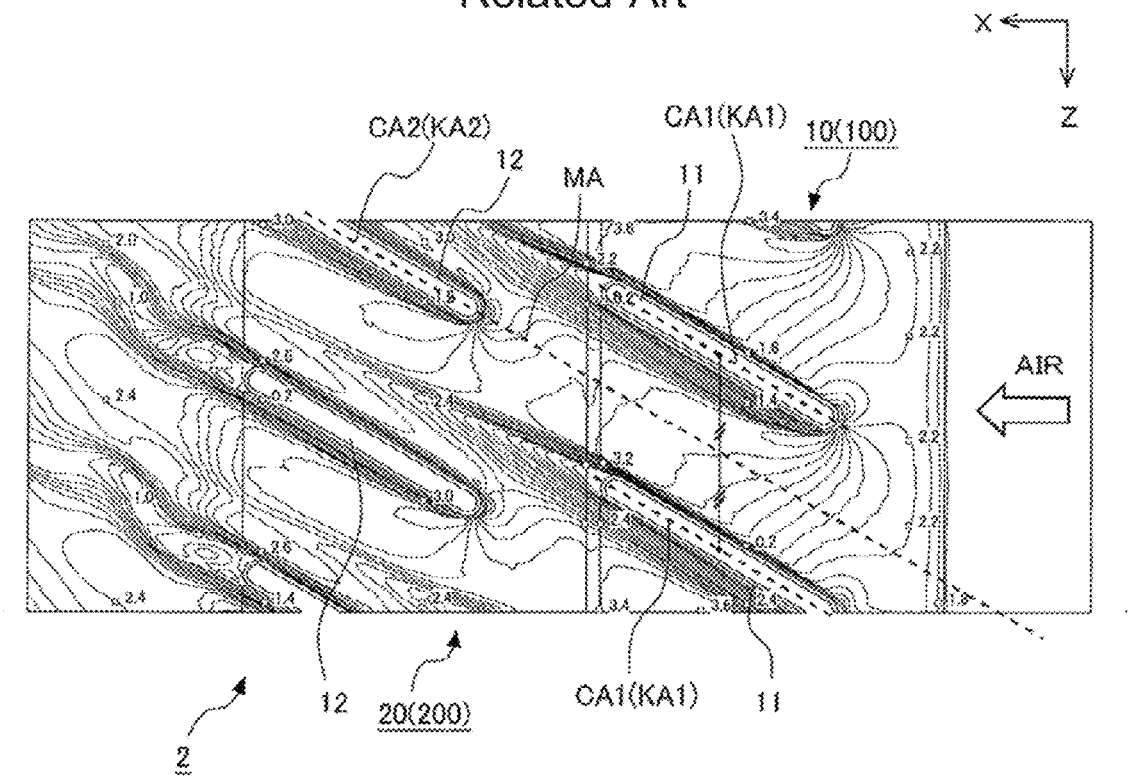
FIG. 5 Related Art
FIG. 5 is a front view for illustrating a flow rate distribution in a heat exchanger 2 according to Comparative Example 1.

FIG. 5 is a front view for illustrating a flow rate distribution in a heat exchanger 2 in Comparative Example 1.

Figure 6:
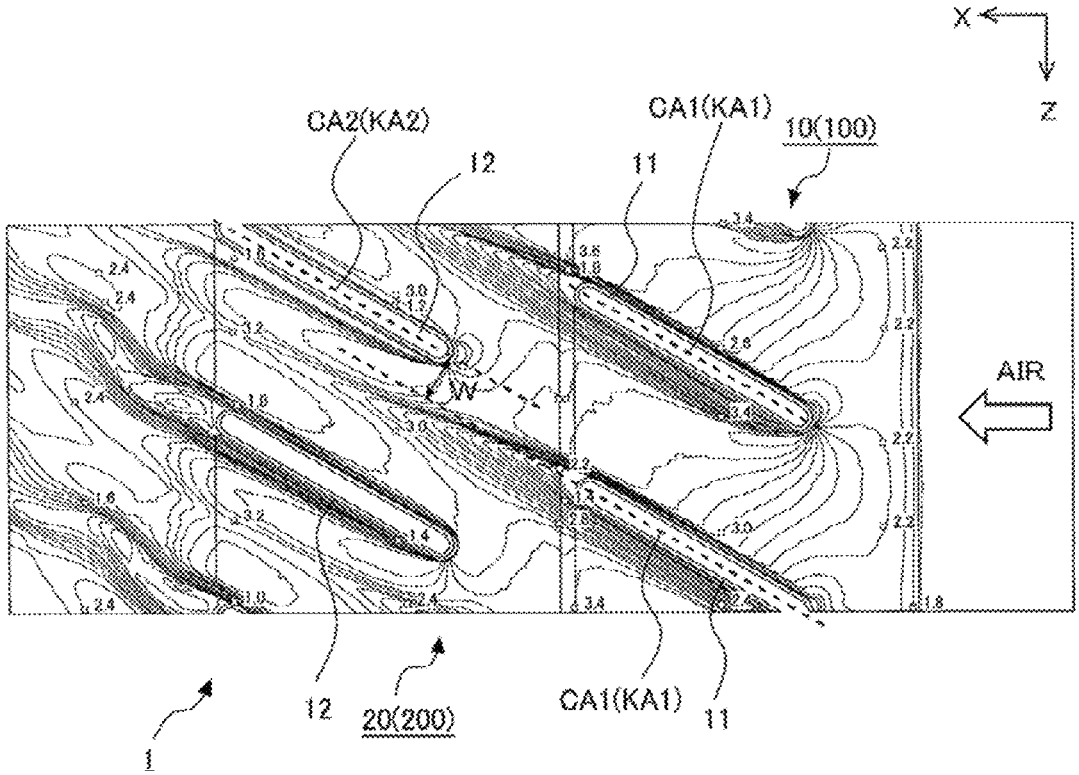
FIG. 6 is a front view for illustrating a flow rate distribution in the heat exchanger 1 according to Embodiment 1.

FIG. 6 is a front view for illustrating a flow rate distribution in the heat exchanger 1 according to Embodiment 1.

In the heat exchanger 2 according to Comparative Example 1, the above-mentioned distance W is $W=0.5\times Dp\times\cos\theta1$, and a general staggered arrangement is employed for the first flat tubes 11 and the second flat tubes 21.

In the description of the heat exchanger 2 of Comparative Example 1, components which are in common with those of the heat exchanger 1 of Embodiment 1 have the same names and are denoted by the same reference symbols.

Air having flowed into the heat exchanger 1 according to Embodiment 1 and the heat exchanger 2 according to Comparative Example 1 is separated at a lower portion of the front edge portion (first arcuate portion 11*d*) of the first flat tube 11. With this action, a main stream of air inside the first heat transfer portion 100 drifts without proceeding along the inclination angle θ1 of the first flat tube 11, and enters toward the second flat tube 21 while rising at an angle smaller than the inclination angle θ1. Thus, as illustrated in FIG. 5, the main stream of air having passed through the first heat transfer portion 100 flows into the second heat transfer portion 200 at a position below an intermediate plane MA of first cross-sectional center planes CA1 (cutout center planes KA1) of the pair of first flat tubes 11 which are vertically arrayed and at an angle smaller than the inclination angle θ1 of the first flat tube 11.

Thus, in the heat exchanger 2 of Comparative Example 1 employing the general staggered arrangement, as illustrated in FIG. 5, a stagnation region in which the air speed on downstream of the first flat tube 11 is low extends to a vicinity of an upper surface of the second flat tube 21, and the air speed on an upper side of the second flat tube 21 is significantly lower than the air speed on a lower side of the second flat tube 21. That is, the flow rate distribution of forming a high air speed region on both upper and lower surfaces of the second flat tube 21, which is an intended effect of the staggered arrangement of the flat tubes, is not achieved, with the result that the heat transfer performance is degraded.

Meanwhile, in the heat exchanger 1 according to Embodiment 1, the distance W between the first cross-sectional center plane CA1 (cutout center plane KA1) of the first flat tube 11 and the second cross-sectional center plane CA2 (cutout center plane KA2) of the second flat tube 21 is $W=\xi\times Dp\times\cos\theta1$ ($0\leq\xi<0.5$). Accordingly, as illustrated in FIG. 6, the second flat tube 21 is arranged in conformity with the drift of air in the first heat transfer portion 100, and hence the air speed on an upper side of the second flat tube 21 is increased as compared to Comparative Example 1 illustrated in FIG. 5. That is, as originally intended for the staggered arrangement of the flat tubes, the high air speed region is formed on both the upper and lower surfaces of the second flat tube 21, thereby being capable of improving the heat transfer performance.

<Discharge Structure for Water Droplets>

Next, with the first heat transfer portion 100, description is made of a discharging step for water droplets which adhere to the cutout region 13 in the heat exchanger 1 according to Embodiment 1.

Water droplets which adhere to the cutout region 13 fall in the gravity direction along the cutout region 13. The water droplets which fall along the cutout region 13 reaches the first surface portion 11*b* being an upper surface of the first flat tube 11. The water droplets having reached the first surface portion 11*b* of the first flat tube 11 flow down to the first arcuate portion 11*d* side (front edge portion side) of the first flat tube 11 along the first surface portion 11*b* under the influence of gravity. Major part of the water droplets having flowed to the first arcuate portion 11*d* side flows into the drainage region 14 with use of the flow rate of the water droplets, and is discharged to a lower side of the first heat transfer portion 100.

Water droplets which have not flowed into the drainage region 14 from the cutout region 13 proceed around along the second arcuate portion 11*e* of the first flat tube 11 to the second surface portion 11*c* being a lower surface of the first flat tube 11. Those water droplets stagnate on the second surface portion 11*c* of the first flat tube 11 and grow thereon under a state in which, for example, a surface tension, a gravity, and a stationary friction force are balanced. When the gravity applied to the water droplets which stagnate overcomes a force in an upward direction of the gravity direction (upward direction in the Z-axis) such as the surface tension, the water droplets are not influenced by the surface tension. Accordingly, the water droplets separate from the second surface portion 11*c* of the first flat tube 11 and fall down.

A discharging step for water droplets which adhere to the cutout region 23 in the second heat transfer portion 200 is the same as the discharging step for water droplets which adhere to the cutout region 13 in the first heat transfer portion 100, and hence description thereof is omitted.

In the heat exchanger 1 according to Embodiment 1, the drainage regions 14 and 24 are arranged on a windward side, and the cutout regions 13 and 23 are arranged on a leeward side. The drainage regions 14 and 24 are arranged farther from the first flat tubes 11 and the second flat tubes 21 as compared to the cutout regions 13 and 23. Therefore, when the heat exchanger 1 is used as an evaporator, the surface temperature in the drainage regions 14 and 24 are above that in the cutout regions 13 and 23. Thus, in the heat exchanger 1 according to Embodiment 1 in which the drainage regions 14 and 24 are arranged on the windward side, an effect of suppressing the amount of frost formation can be achieved, thereby being capable of suppressing the defrosting mode operation time.

In the heat exchanger 1 according to Embodiment 1, as one example, conditions of $\theta1=\theta2=30°$ and $\xi=0.25$ may be given. However, the present invention is not limited to such configuration.

<Effect>

With the configuration of the heat exchanger 1 according to Embodiment 1, the first flat tubes 11 and the second flat tubes 21 are inclined, thereby being capable of improving the drainage performance. Further, positions of the second flat tubes 21 with respect to the first flat tube 11 are specified so that the heat exchange fluid is effectively brought into contact with the second flat tube 21, thereby being capable of obtaining a heat exchanger which secures the heat transfer performance.

Embodiment 2

In the heat exchanger 1 according to Embodiment 2 of the present invention, a configuration of the first cutout portion 12 and a second cutout portion 22 formed in the first fin 10 and the second fin 20 is different from that of the heat exchanger 1 according to Embodiment 1. Therefore, description is made mainly on the above-mentioned difference. Other configuration related to the heat exchanger 1 is in common with Embodiment 1, and hence description is omitted.

Figure 7:
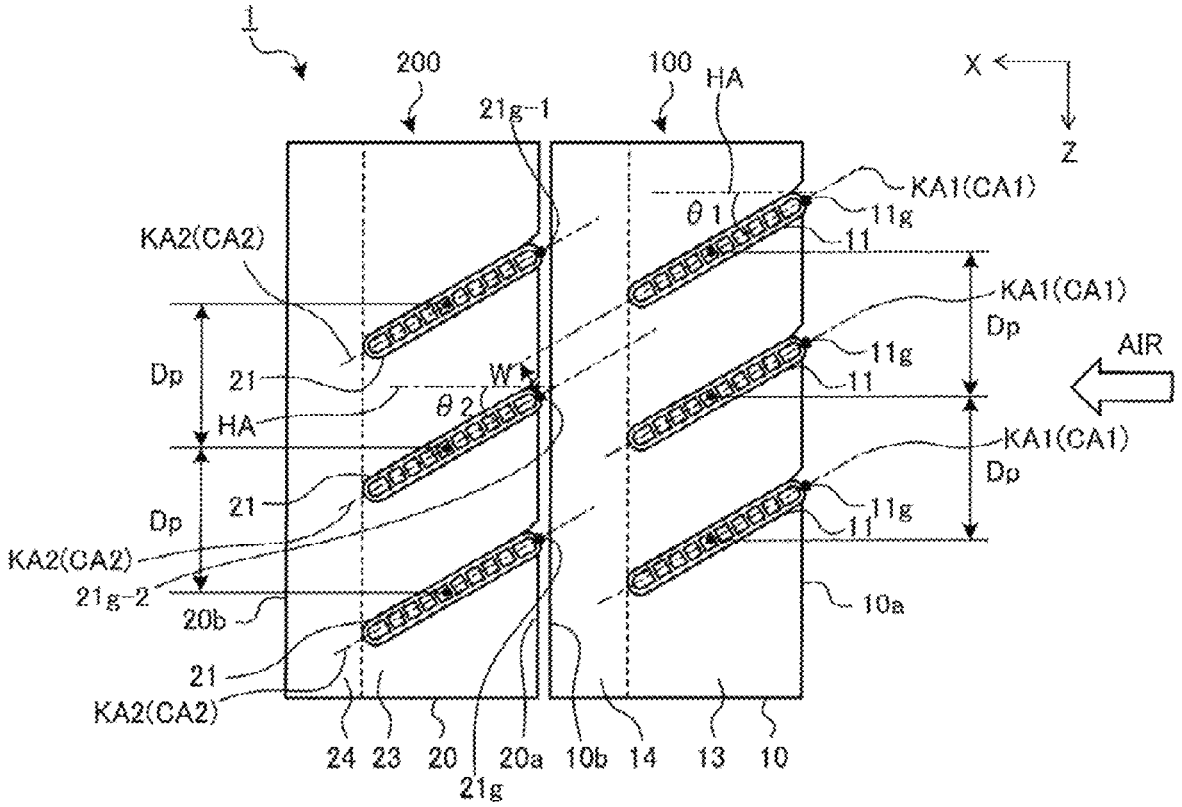
FIG. 7 is a front view for illustrating the heat exchanger 1 according to Embodiment 2 of the present invention.

FIG. 7 is a front view for illustrating the heat exchanger 1 according to Embodiment 2.

Figure 8:
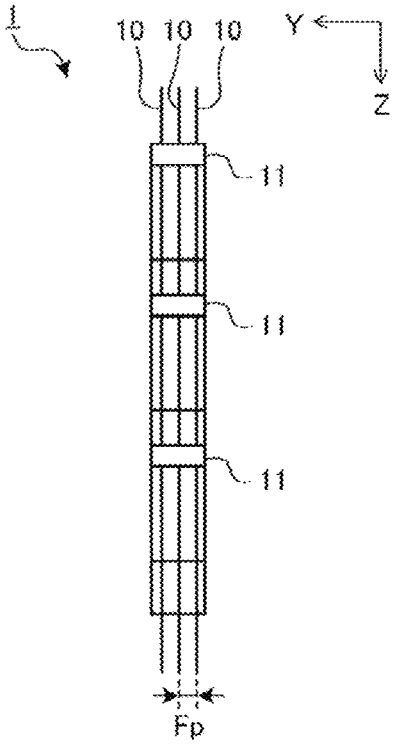
FIG. 8 is a side view for illustrating the heat exchanger 1 according to Embodiment 2.

FIG. 8 is a side view for illustrating the heat exchanger 1 according to Embodiment 2.

Figure 9:
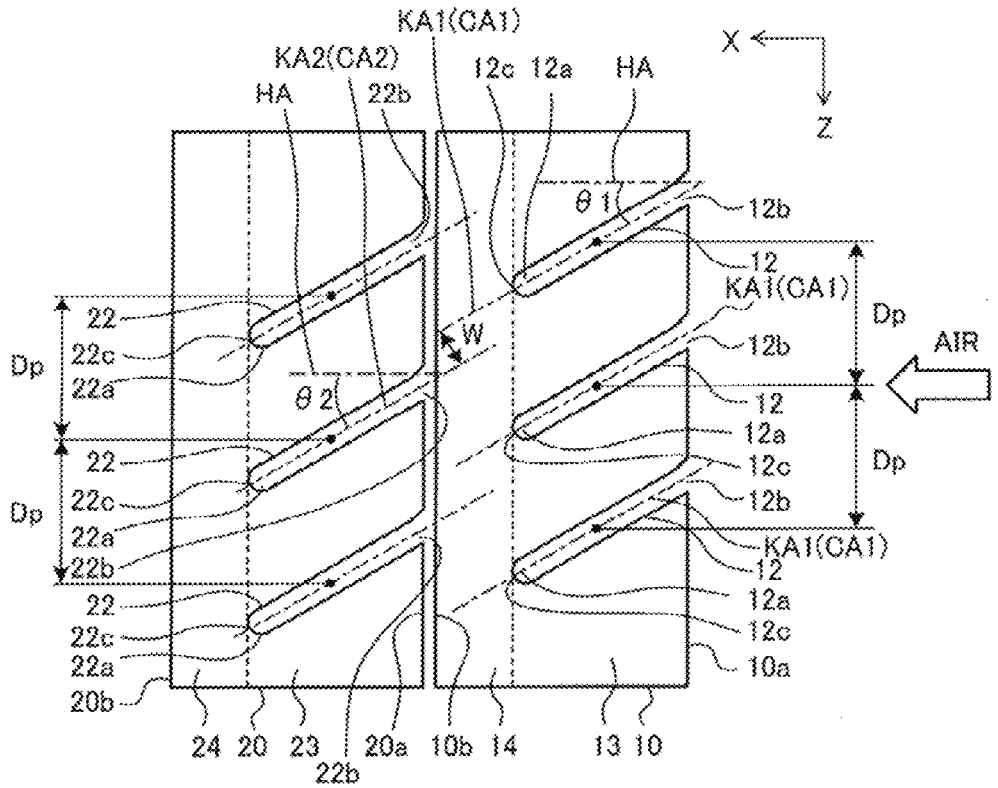
FIG. 9 is a front view for illustrating the first fin 10 and the second fin 20 in Embodiment 2.

FIG. 9 is a front view for illustrating the first fin 10 and the second fin 20 in Embodiment 2.

Figure 10:
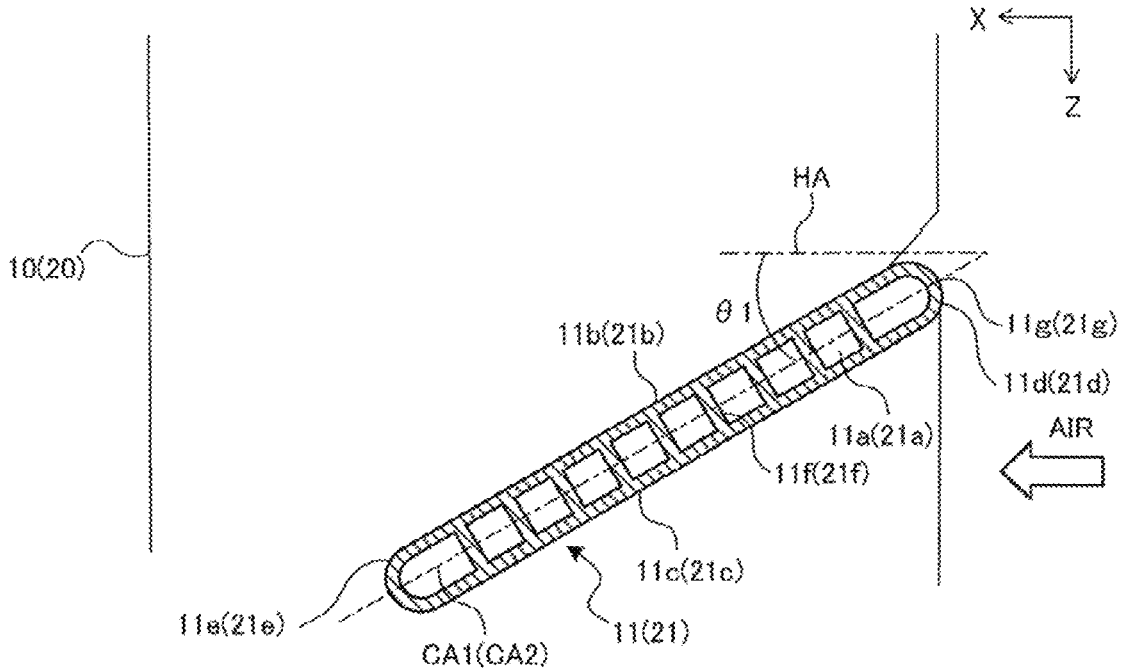
FIG. 10 is a sectional view of the first flat tube 11 (second flat tube 21) mounted to the first fin 10 (second fin 20) in Embodiment 2.

FIG. 10 is a sectional view of the first flat tube 11 (second flat tube 21) mounted to the first fin 10 (second fin 20) in Embodiment 2.

With reference to FIG. 7 to FIG. 10, the heat exchanger 1 is described below.

<Configuration of First Fin 10>

As illustrated in FIG. 7 and FIG. 9, the first fin 10 has the cutout region 13 and the drainage region 14.

The cutout region 13 is a region in which the plurality of first cutout portions 12 are formed along a longitudinal direction being the gravity direction (Z-axis direction). As illustrated in FIG. 7, the first cutout portions 12 of the first fin 10 are each cut out so as to extend from the one-side portion 10*a* side toward the another-side portion 10*b* of the first fin 10, and are each formed into an elongated shape conforming to the outer diameter of the first flat tube 11. The plurality of first cutout portions 12 are formed to be parallel to each other and have the same shape. The first flat tubes 11 are inserted into the first cutout portions 12 and joined by brazing.

The drainage region 14 is a region in which no first cutout portion 12 is formed along the longitudinal direction (Z-axis direction), and the first fin 10 is formed continuously. The drainage region 14 is a region in which water having adhered to the first fin 10 is discharged in the gravity direction. The drainage region 14 is arranged downstream of the cutout region 13 (another-side portion 10*b* side of the first fin 10) of the cutout region 13 in the flow direction (X-axis direction) of air being the heat exchange fluid.

The depth-side portion 12*a* side of the first cutout portion 12 is positioned below the insertion portion 12*b* side of the first cutout portion 12 in the gravity direction (Z-axis direction). As illustrated in FIG. 9, the first cutout portion 12 is formed with inclination such that an angle formed between the cutout center plane KA1, which is an imaginary center plane of the first cutout portion 12 in the short-length direction (width direction), and the horizontal plane HA is the predetermined inclination angle $\theta1$. Further, the distance between first cutout portions 12, which are vertically adjacent to each other, in the gravity direction (Z-axis direction) is constant at the stage pitch (distance) Dp as illustrated in FIG. 3.

As illustrated in FIG. 7, the plurality of first flat tubes 11 are mounted to the plurality of first cutout portions 12 of the first fin 10 so as to intersect with the first fin 10. As illustrated in FIG. 10, the cross-sectional shape of the outer shell of the first flat tube 11 includes the pair of first surface portion 11*b* and the second surface portion 11*c* facing each other, and includes the first arcuate portion 11*d* and the second arcuate portion 11*e* at both end portions. Further, on the inner side of the surfaces forming the outer shell, the plurality of refrigerant flow passages 11*a* which are partitioned by the partition walls 11*f* are formed. The cross-sectional shape of the outer shell of the first flat tube 11 may be a substantially elliptical cross-sectional shape.

The wall surface of the refrigerant flow passage 11*a*, that is, the inner wall surface of the first flat tube 11 may have a groove. With such a groove, a contact area between the inner wall surface of the first flat tube 11 and refrigerant increases, and thus the heat transfer performance improves. The first flat tube 11 is made of, for example, aluminum or aluminum alloy.

Under a state in which the first flat tube 11 is mounted to the first cutout portion 12, the first arcuate portion 11*d* side of the first flat tube 11 (which corresponds to the front edge portion of the present invention provided upstream in the flow direction (X-axis direction) of air being the heat exchange fluid) is positioned above the second arcuate portion 11*e* side (which corresponds to the rear edge portion of the present invention on downstream in the flow direction (X-axis direction) of air being the heat exchange fluid) in the gravity direction (Z-axis direction). Further, as described above, the first flat tube 11 is fixed to the first cutout portion 12. Therefore, the first cross-sectional center plane CA1, which is an imaginary plane passing through the center of the direction of short-axis in the flow passage cross section of the first flat tube 11 (direction perpendicular to the first surface portion 11*b* and the second surface portion 11*c*), and the cutout center plane KA1 are in flush with each other. Accordingly, the first flat tube 11 is arranged with inclination such that the angle formed between the first cross-sectional center plane CA1 of the first flat tube 11 and the horizontal plane HA is the predetermined inclination angle $\theta1$. The distance between first flat tubes 11, which are vertically adjacent to each other, in the gravity direction (Z-axis direction) is constant at the stage pitch (distance) Dp. Further, the intersecting line between the first arcuate portion 11*d* and the first cross-sectional center plane CA1 is se as the front-most edge line 11*g* of the first flat tube 11.

<Configuration of Second Fin 20>

As illustrated in FIG. 7 and FIG. 9, the second fin 20 has the cutout region 23 and the drainage region 24.

The cutout region 23 is a region in which a plurality of second cutout portions 22 are formed along the longitudinal direction being the gravity direction (Z-axis direction). As illustrated in FIG. 3, the second cutout portions 22 of the second fin 20 are each cut out so as to extend from the one-side portion 20*a* side toward the another-side portion 20*b* side of the second fin 20, and are each formed into an elongated shape conforming to the outer diameter of the second flat tube 21. The plurality of second cutout portions 22 are formed to be parallel to each other and have the same shape. The second flat tubes 21 are inserted into the second cutout portions 22 and joined by brazing.

The drainage region 24 is a region in which no second cutout portion 22 is formed along the longitudinal direction (Z-axis direction), and the second fin 20 is formed continuously. The drainage region 24 is a region in which water having adhered to the second fin 20 is discharged in the gravity direction. The drainage region 24 is arranged downstream of the cutout region 23 (another-side portion 20*b* side of the first fin 10) of the cutout region 23 in the flow direction (X-axis direction) of air being the heat exchange fluid.

The depth-side portion 22*a* side of the second cutout portion 22 is positioned below the insertion portion 22*b* side of the second cutout portion 22 in the gravity direction (Z-axis direction). As illustrated in FIG. 9, the second cutout portion 22 is formed with inclination such that the angle formed between the cutout center plane KA2, which is an imaginary center plane of the second cutout portion 22 in the short-length direction (width direction), and the horizontal plane HA is the predetermined inclination angle θ2. Further, the distance between second cutout portions 22, which are vertically adjacent to each other, in the gravity direction (Z-axis direction) is constant at the stage pitch (distance) Dp as illustrated in FIG. 9.

As illustrated in FIG. 7, the plurality of second flat tubes 21 are mounted to the plurality of second cutout portions 22 of the second fin 20 so as to intersect with the second fin 20. As illustrated in FIG. 10, the cross-sectional shape of the outer shell of the second flat tube 21 includes the pair of first surface portion 21*b* and the second surface portion 21*c* facing each other, and includes the first arcuate portion 21*d* and the second arcuate portion 21*e* at both end portions. Further, on the inner side of the surfaces forming the outer shell, the plurality of refrigerant flow passages 21*a* which are partitioned by the partition walls 21*f* are formed. The cross-sectional shape of the outer shell of the second flat tube 21 may be a substantially elliptical cross-sectional shape.

The wall surface of the refrigerant flow passage 21*a*, that is, the inner wall surface of the second flat tube 21 wall surface may have a groove. With such a groove, a contact area between the inner wall surface of the second flat tube 21 and refrigerant increases, and thus the heat transfer performance improves. The second flat tube 21 is made of, for example, aluminum or aluminum alloy.

Under a state in which the second flat tube 21 is mounted to the second cutout portion 22, the first arcuate portion 21*d* side of the second flat tube 21 (which corresponds to the front edge portion provided upstream in the flow direction (X-axis direction) of air being the heat exchange fluid) is positioned above the second arcuate portion 21*e* side (which corresponds to the rear edge portion on downstream in the flow direction (X-axis direction) of air being the heat exchange fluid) in the gravity direction (Z-axis direction). Further, as described above, the second flat tube 21 is fixed to the second cutout portion 22. Therefore, the second cross-sectional center plane CA2 being the imaginary plane passing through the center of the short-axis direction in the flow passage cross section of the second flat tube 21 (direction perpendicular to the first surface portion 21*b* and the second surface portion 21*c*) and the cutout center plane KA2 are in flush with each other. Accordingly, the second flat tube 21 is arranged with inclination such that an angle formed between the second cross-sectional center plane CA2 of the second flat tube 21 and the horizontal plane HA is the predetermined inclination angle θ2.

The inclination angle θ1 and the inclination angle θ2 in Embodiment 2 are equal to each other. Further, the distance between second flat tubes 21, which are vertically adjacent to each other, in the gravity direction (Z-axis direction) is constant at the stage pitch (distance) Dp. Further, the intersecting line between the first arcuate portion 21*d* and the second cross-sectional center plane CA2 is set as the front-most edge line 21*g* of the second flat tube 21.

<Positional Relationship of First Flat Tubes 11 and Second Flat Tubes 21>

Description is made of a positional relationship of cutout center planes KA2 of a pair of second cutout portions 22, which are vertically adjacent to each other in the gravity direction (Z-axis direction), and the cutout center plane KA1 of the first cutout portion 12 which is positioned between the pair of cutout center planes KA2.

As illustrated in FIG. 7 and FIG. 9, the distance between the cutout center plane KA2, which is one of the pair of second cutout portions 22 positioned on a lower side in the gravity direction (Z-axis direction), and the cutout center plane KA1 of the first cutout portion 12 positioned between the pair of cutout center planes KA2 is defined as the distance W. In the heat exchanger 1 of Embodiment 2, the distance W as a function of the stage pitch (distance) Dp is expressed with $W=\xi\times Dp\times\cos\theta1$. An eccentricity ξ is a coefficient which falls within the range of $0\leq\xi<0.5$. With such a configuration of the first cutout portions 12 and the second cutout portions 22, the positional relationship of the first flat tubes 11 and the second flat tubes 21 which are inserted into respective cutout portions is determined.

That is, when the first flat tube 11 and the second flat tube 21 are fixed to the first cutout portion 12 and the second cutout portion 22, respectively, the plurality of first flat tubes 11 are arranged so that the angle θ1 is formed between the first cross-sectional center plane CA1 being the imaginary plane passing through the center of the direction of short-axis of the flow passage cross section and the flow direction (X-axis direction) of air. The plurality of second flat tubes 21 are arranged so that the angle θ2 is formed between the second cross-sectional center plane CA2 being the imaginary center plane in the direction of short-axis of the flow passage cross section and the flow direction (X-axis direction) of air.

Further, the first flat tube 11 and the second flat tube 21 are arranged with inclination such that the front edge portions thereof (first arcuate portions 11*d* and 21*d*) in the flow direction (X-axis direction) of air are above the rear edge portions thereof (second arcuate portions 11*e* and 21*e*).

Further, the plurality of second flat tubes 21 each have the front-most edge line 21*g* provided upstream in the flow direction, and the pair of front-most edge lines 21*g* adjacent to each other in the gravity direction (Z-axis direction) have the first front-most edge line 21*g*−1 positioned on an upper side in the gravity direction and the second front-most edge line 21*g*−2 positioned on a lower side in the gravity direction. Accordingly, the second front-most edge line 21*g*−2 and the first cross-sectional center plane CA1 of the first flat tube 11, which is positioned between the first front-most edge line 21*g*−1 and the second front-most edge line 21*g*−2, are arranged to be spaced apart from each other by the distance W. In this case, the distance W is a dimension which satisfies $W=\xi\times Dp\times\cos\theta1$ where $0\leq\xi<0.5$.

<Actions of Arrangement of First Flat Tubes 11 and Second Flat Tubes 21>

Description is made of actions of the heat exchanger 1 of Embodiment 2.

Figure 11:
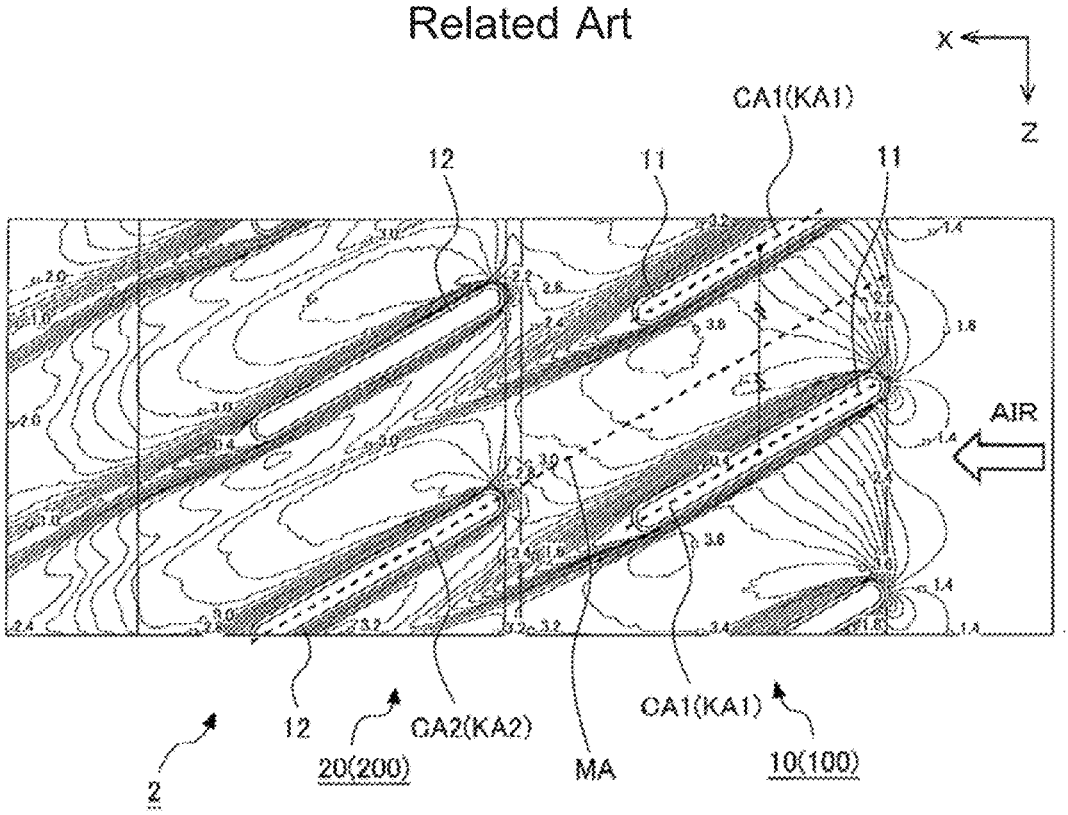
FIG. 11 Related Art
FIG. 11 is a front view for illustrating a flow rate distribution in the heat exchanger 2 according to Comparative Example 2.

FIG. 11 is a front view for illustrating a flow rate distribution in the heat exchanger 2 in Comparative Example 2.

Figure 12:
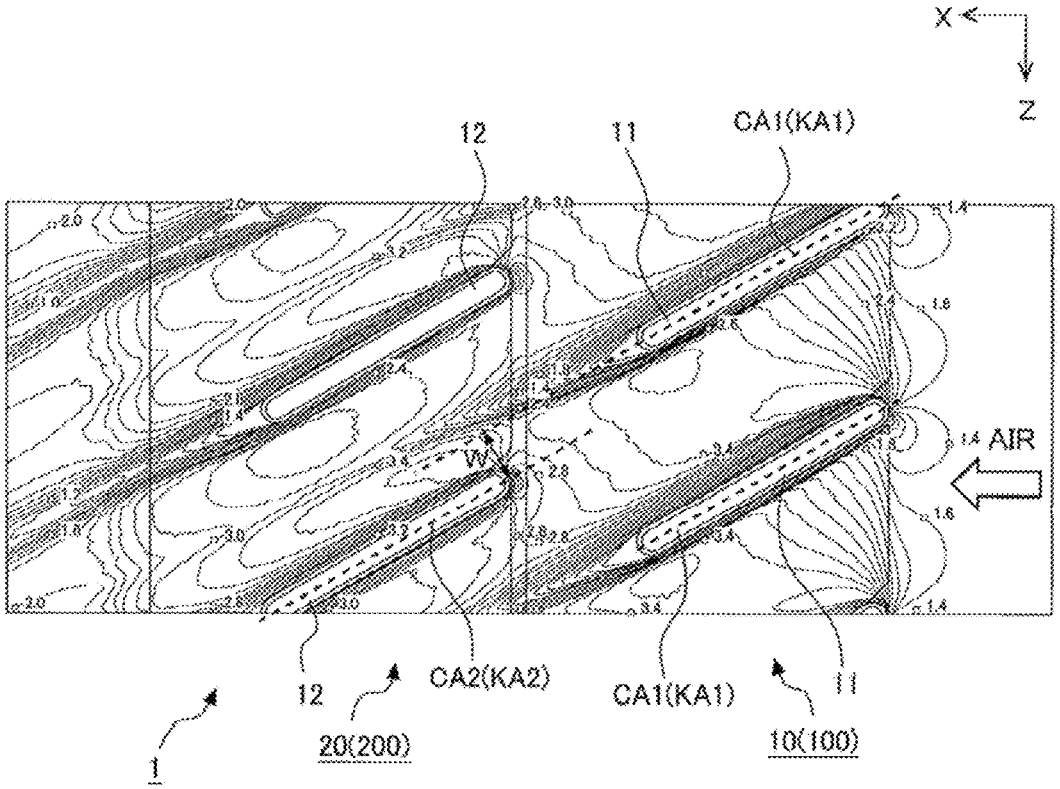
FIG. 12 is a front view for illustrating a flow rate distribution in the heat exchanger 1 according to Embodiment 2.

FIG. 12 is a front view for illustrating a flow rate distribution in the heat exchanger 1 according to Embodiment 2.

In the heat exchanger 2 according to Comparative Example 2, the above-mentioned distance W is $W=0.5\times Dp\times\cos\theta1$, and a general staggered arrangement is employed for the first flat tubes 11 and the second flat tubes 21.

In the description of the heat exchanger 2 of Comparative Example 2, components which are in common with those of the heat exchanger 1 of Embodiment 2 have the same names and are denoted by the same reference symbols.

Air having flowed into the heat exchanger 1 according to Embodiment 2 and the heat exchanger 2 according to Comparative Example 2 is separated at the upper portion of the front edge portion (first arcuate portion 11*d*) of the first flat tube 11. With this action, the main stream of air inside the first heat transfer portion 100 drifts without proceeding along the inclination angle θ1 of the first flat tube 11, and enters toward the second flat tube 21 while descending at an angle smaller than the inclination angle θ1. Thus, as illustrated in FIG. 11, the main stream of air having passed through the first heat transfer portion 100 flows into the second heat transfer portion 200 at a position above the intermediate plane MA of the first cross-sectional center planes CA1 (cutout center planes KA1) of the pair of first flat tubes 11 which are vertically arrayed and at an angle smaller than the inclination angle θ1 of the first flat tube 11.

Thus, in the heat exchanger 2 of Comparative Example 2 employing the general staggered arrangement, as illustrated in FIG. 11, the stagnation region in which the air speed on downstream of the first flat tube 11 is low extends to a vicinity of a lower surface of the second flat tube 21, and the air speed on a lower side of the second flat tube 21 is significantly lower than the air speed on an upper side of the second flat tube 21. That is, the flow rate distribution of forming the high air speed region on both the upper and lower surfaces of the second flat tube 21, which is an intended effect of the staggered arrangement of the flat tubes, is not achieved, with the result that the heat transfer performance is degraded.

Meanwhile, in the heat exchanger 1 according to Embodiment 2, the distance W between the first cross-sectional center plane CA1 (cutout center plane KA1) of the first flat tube 11 and the second cross-sectional center plane CA2 (cutout center plane KA2) of the second flat tube 21 is $W=\xi\times Dp\times\cos\theta1$ ($0\leq\xi<0.5$). Accordingly, as illustrated in FIG. 12, the second flat tube 21 is arranged in conformity with the drift of air in the first heat transfer portion 100, and hence the air speed on a lower side of the second flat tube 21 is increased as compared to Comparative Example 2 illustrated in FIG. 11. That is, as originally intended for the staggered arrangement of the flat tubes, the high air speed region is formed on both the upper and lower surfaces of the second flat tube 21, thereby being capable of improving the heat transfer performance.

<Discharge Structure for Water Droplets>

Next, with the first heat transfer portion 100, description is made of the discharging step for water droplets which adhere to the cutout region 13 in the heat exchanger 1 according to Embodiment 2.

Water droplets which adhere to the cutout region 13 fall in the gravity direction along the cutout region 13. The water droplets which fall along the cutout region 13 reaches the first surface portion 11*b* being the upper surface of the first flat tube 11. The water droplets having reached the first surface portion 11*b* of the first flat tube 11 flow down to the second arcuate portion 11*e* side (rear edge portion side) of the first flat tube 11 along the first surface portion 11*b* under the influence of gravity. Major part of the water droplets having flowed to the second arcuate portion 11*e* side flows into the drainage region 14 with use of the flow rate of the water droplets, and is discharged to a lower side of the first heat transfer portion 100.

Water droplets which have not flowed into the drainage region 14 from the cutout region 13 proceed around along the second arcuate portion 11*e* of the first flat tube 11 to the second surface portion 11*c* being the lower surface of the first flat tube 11. Those water droplets stagnate on the second surface portion 11*c* of the first flat tube 11 and grow thereon under a state in which, for example, a surface tension, a gravity, and a stationary friction force are balanced. When the gravity applied to the water droplets which stagnate overcomes a force in an upward direction of the gravity direction (upward direction in the Z-axis) such as the surface tension, the water droplets are not influenced by the surface tension. Accordingly, the water droplets separate from the second surface portion 11*c* of the first flat tube 11 and fall down.

The discharging step for water droplets which adhere to the cutout region 23 in the second heat transfer portion 200 is the same as the discharging step for water droplets which adhere to the cutout region 13 in the first heat transfer portion 100, and hence description thereof is omitted.

In the heat exchanger 1 according to Embodiment 2, the drainage regions 14 and 24 are arranged on the leeward side. Therefore, water droplets can be introduced to the drainage regions 14 and 24 with use of an airflow during the defrosting mode operation. With this configuration, the drainage performance is improved, thereby being capable of suppressing the defrosting mode operation time.

In the heat exchanger 1 according to Embodiment 2, as one example, conditions of $\theta1=\theta2=30°$ and $\xi=0.25$ may be given. However, the present invention is not limited to such configuration.

<Effect>

With the configuration of the heat exchanger 1 according to Embodiment 2, the first flat tubes 11 and the second flat tubes 21 are inclined, thereby being capable of improving the drainage performance. Further, positions of the second flat tubes 21 with respect to the first flat tube 11 are specified so that the heat exchange fluid is effectively brought into contact with the second flat tube 21, thereby being capable of obtaining a heat exchanger which secures the heat transfer performance.

Embodiment 3

In the heat exchanger 1 according to Embodiment 3 of the present invention, a configuration of the first cutout portion 12 and a second cutout portion 22 formed in the first fin 10 and the second fin 20 is different from that of the heat exchanger 1 according to Embodiment 1. Therefore, description is made mainly on the above-mentioned difference. Other configuration related to the heat exchanger 1 is in common with Embodiment 1, and hence description is omitted.

Figure 13:
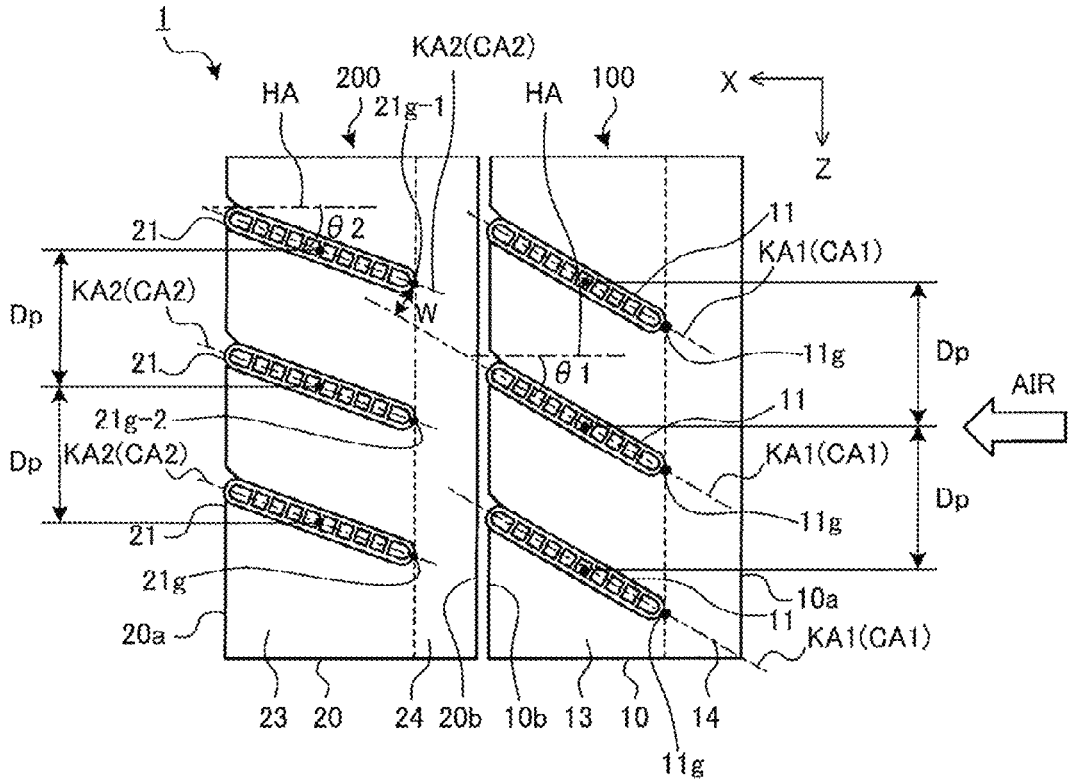
FIG. 13 is a front view for illustrating the heat exchanger 1 according to Embodiment 3 of the present invention.

FIG. 13 is a front view for illustrating the heat exchanger 1 according to Embodiment 3.

Figure 14:
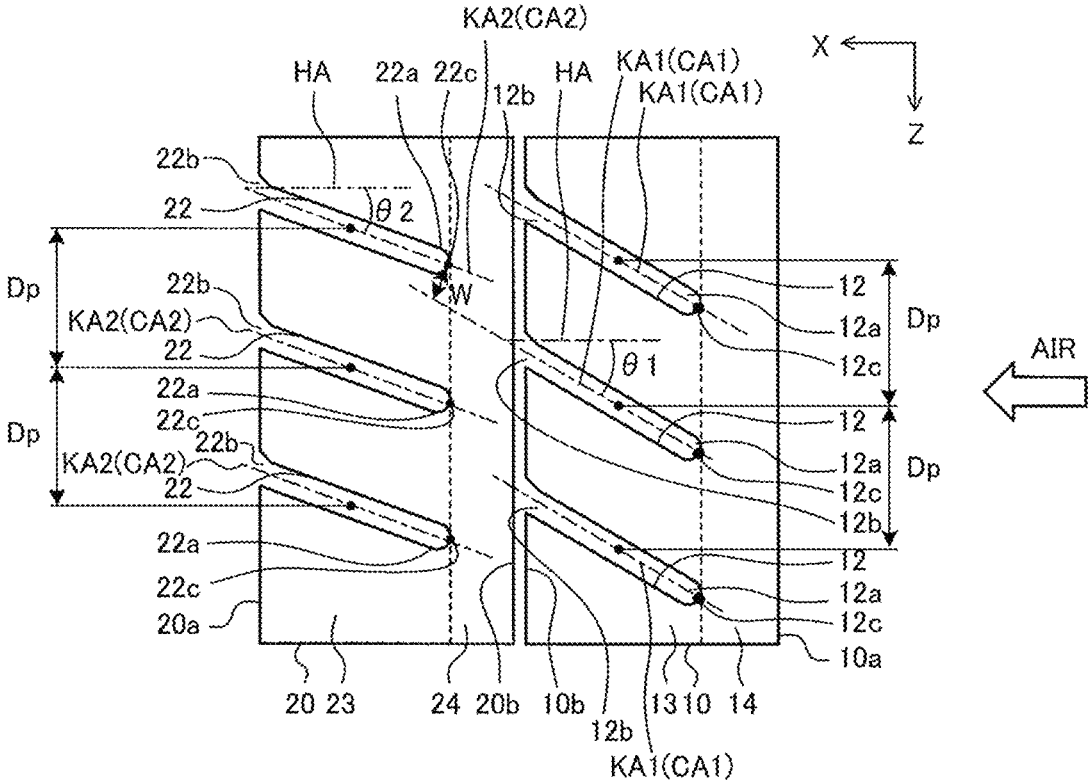
FIG. 14 is a front view for illustrating the first fin 10 and the second fin 20 in Embodiment 3.

FIG. 14 is a front view for illustrating the first fin 10 and the second fin 20 in Embodiment 3.

Figure 15:
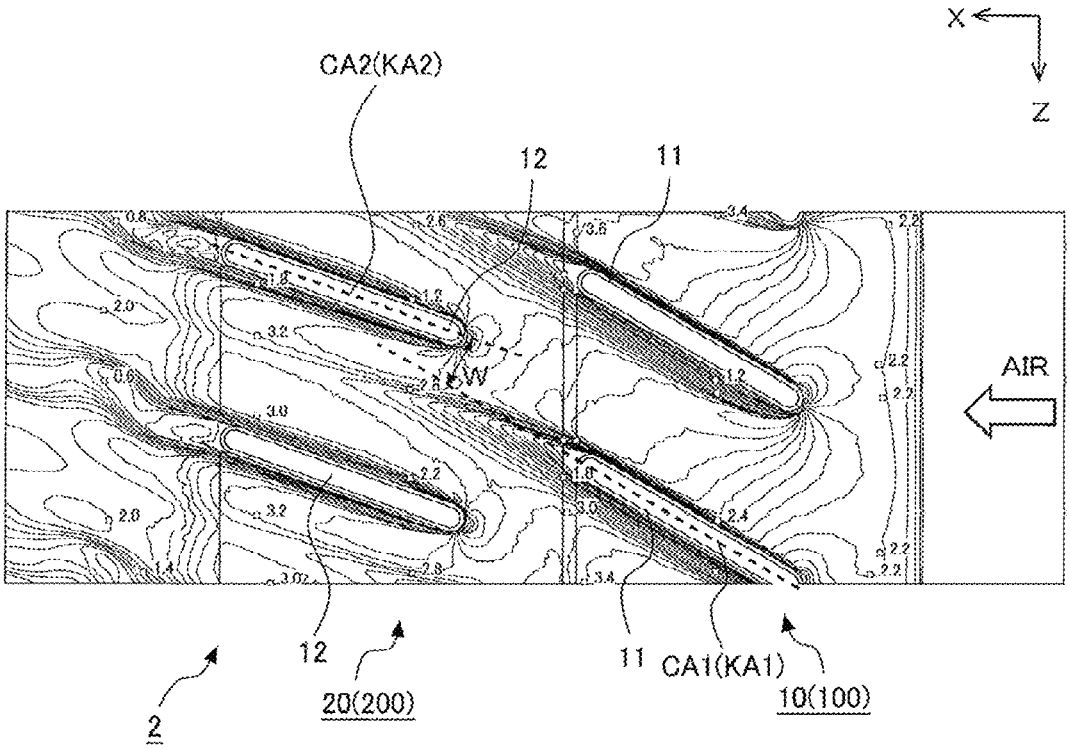
FIG. 15 is a front view for illustrating a flow rate distribution in the heat exchanger 1 according to Embodiment 3.

FIG. 15 is a front view for illustrating a flow rate distribution in the heat exchanger 1 according to Embodiment 3.

Now, with reference to FIG. 13 to FIG. 15, description is made of a configuration and an action of the heat exchanger 1.

As described in Embodiment 1, air having flowed into the heat exchanger 1 is separated at a lower part of the front edge portion (first arcuate portion 11*d*) of the first flat tube 11. With this action, a main stream of air inside the first heat transfer portion 100 drifts without proceeding along the inclination angle θ1 of the first flat tube 11, and enters toward the second flat tube 21 while rising at an angle smaller than the inclination angle θ1.

The heat exchanger 1 according to Embodiment 3 has a configuration which is basically the same as that of Embodiment 1 described above. However, in conformity with a rising angle of the main stream inside the first heat transfer portion 100, the inclination angle θ2 of the second flat tube 21 is formed smaller than the inclination angle θ1 of the first flat tube 11.

<Positional Relationship of First Flat Tubes 11 and Second Flat Tubes 21>

Description is made of a positional relationship of the cutout center planes KA2 of the pair of second cutout portions 22, which are vertically adjacent to each other in the gravity direction (Z-axis direction), and the cutout center plane KA1 of the first cutout portion 12 which is positioned between the pair of cutout center planes KA2.

As illustrated in FIG. 13 and FIG. 14, when the first flat tube 11 and the second flat tube 21 are fixed to the first cutout portion 12 and the second cutout portion 22, respectively, the plurality of first flat tubes 11 are arranged so that the angle θ1 is formed between the first cross-sectional center plane CA1 being the imaginary plane passing through the center of the direction of short-axis of the flow passage cross section and the flow direction (X-axis direction) of air. Further, the plurality of second flat tubes 21 are arranged so that the angle θ2 is formed between the second cross-sectional center plane CA2 being the imaginary plane passing through the center of the direction of short-axis of the flow passage cross section and the flow direction (X-axis direction) of air.

The first flat tube 11 and the second flat tube 21 are arranged with inclination such that the front edge portions thereof (first arcuate portions 11*d* and 21*d*) in the flow direction (X-axis direction) of air are below the rear edge portions thereof (second arcuate portions 11*e* and 21*e*).

Further, the plurality of second flat tubes 21 each have the front-most edge line 21*g* provided upstream in the flow direction, and the pair of front-most edge lines 21*g* adjacent to each other in the gravity direction (Z-axis direction) have the first front-most edge line 21*g*−1 positioned on an upper side in the gravity direction and the second front-most edge line 21*g*−2 positioned on a lower side in the gravity direction. Accordingly, the first front-most edge line 21*g*−1 and the first cross-sectional center plane CA1 of the first flat tube 11, which is positioned between the first front-most edge line 21*g*−1 and the second front-most edge line 21*g*−2, are arranged to be spaced apart from each other by the distance W. In this case, the distance W is a dimension which satisfies $W=\xi\times Dp\times\cos\theta1$ where $0\leq\xi<0.5$.

Further, as illustrated in FIG. 13 and FIG. 14, the inclination angle θ2 of the second flat tube 21 is formed smaller than the inclination angle θ1 of the first flat tube 11 in conformity with a rising angle of the main stream inside the first heat transfer portion 100.

<Effect>

With the configuration of the second flat tube 21, as illustrated in FIG. 15, the inflow angle of air which flows into the second flat tube 21 at an angle smaller than the inclination angle θ1 of the first flat tube 11 can be matched with the inclination angle θ2 of the second flat tube 21.

Therefore, it is possible to obtain the heat exchanger 1 with high heat exchange efficiency, which suppresses pressure loss by smoothing the flow at the front edge portion (first arcuate portion 21*d*) of the second flat tube 21 and suppresses deviation in air speed on the upper and lower surfaces of the second flat tube 21.

According to Embodiment 3, as one example, conditions of θ1=30°, θ2=20°, and ξ=0.25 may be given. However, the present invention is not limited to such configuration.

<Inclination Angles θ1 and θ2 of First Flat Tubes 11 and Second Flat Tubes 21>

In order to improve the drainage performance of the heat exchanger 1 according to Embodiment 1 to Embodiment 3, it is desired that the inclination angles θ1 and θ2 be set large. Meanwhile, when the inclination angles θ1 and θ2 are set larger, the pressure loss on the air side in the heat exchanger 1 increases. That is, it is important to select the inclination angles θ1 and θ2 which provide a balance between the drainage performance and the pressure loss on the air side.

Further, in order to improve a heat transfer rate α in the heat exchanger 1 according to Embodiment 1 to Embodiment 3, it is required to increase the air speed on the tube wall surface of the second flat tube 21. However, when the air speed is increased, the pressure loss on the air side also increases. When the pressure loss increases, the air-sending resistance increases, thereby increasing the load on the air-sending means. Accordingly, in order to obtain the same air amount, it is required that input of the air-sending means be increased. Further, when the input to the air-sending means is maintained, the air-sending amount is reduced, with the result that the heat transfer rate α is degraded. That is, it is also important to select the inclination angles θ1 and θ2 which provide a balance between the heat transfer rate α and the pressure loss on the air side.

Figure 16:
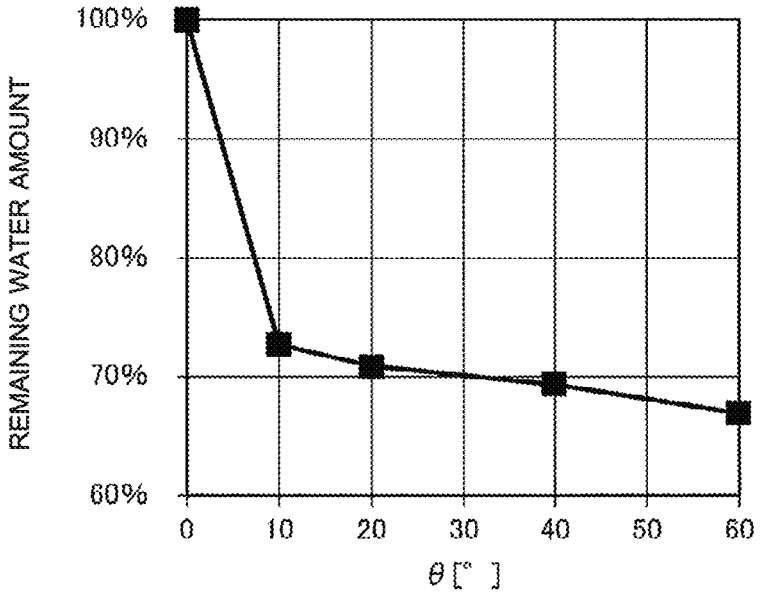
FIG. 16 is a graph for showing a relationship between an inclination angle θ of the flat tube and a remaining water amount in Embodiment 1 and Embodiment 2.

FIG. 16 is a graph for showing a relationship between the inclination angle θ of a flat tube and a remaining water amount in Embodiment 1 and Embodiment 2.

Figure 17:
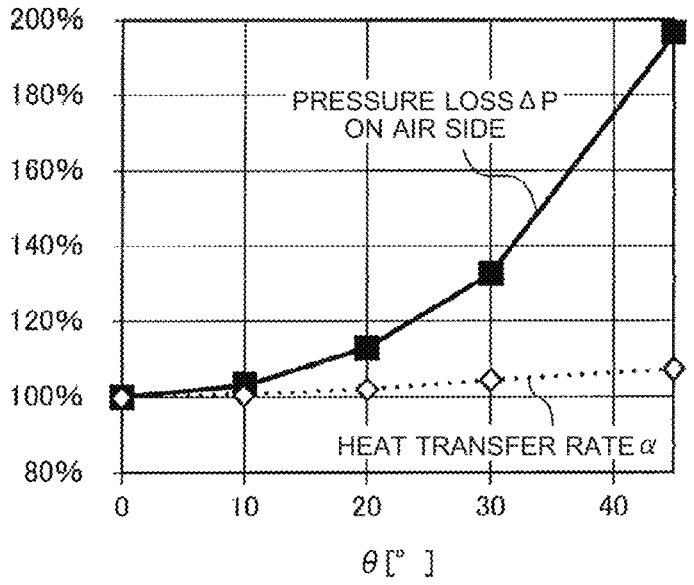
FIG. 17 is a graph for showing a relationship of the inclination angle θ of the flat tube with respect to a pressure loss ΔP and a heat transfer rate α in Embodiment 1 and Embodiment 2.

FIG. 17 is a graph for showing a relationship of the inclination angle θ of the flat tube with respect to the pressure loss ΔP and the heat transfer rate α in Embodiment 1 and Embodiment 2.

The inclination angles θ1 and θ2 of the first flat tube 11 and the second flat tube 21 in FIG. 16 and FIG. 17 are set with the conditions of θ1=θ2=θ and ξ=0.25.

As shown in FIG. 16, the remaining water amount in the heat exchanger 1 is steeply decreases around the inclination angle θ=0° of the first flat tube 11 and the second flat tube 21 but tends to be saturated at an angle of equal to or larger than 20 degrees, with the result that significant improvement in drainage performance cannot be expected. Further, as shown in FIG. 17, when the inclination angle θ of the first flat tube 11 and the second flat tube 21 becomes larger, a gap distance between vertically arrayed flat tubes decreases, and hence the air speed increases. Accordingly, the heat transfer rate $\alpha$ is slightly increased, but increase in pressure loss $\Delta P$ along with increase in inclination angle $\theta$ is doubled at the inclination angle $\theta=45°$ with respect to the inclination angle $\theta=0°$, and hence the increase is prominent. Thus, in consideration of the balance in performance based on those results, it is desired that the inclination angle $\theta$ be set to equal to or smaller than 20 degrees.

Figure 18:
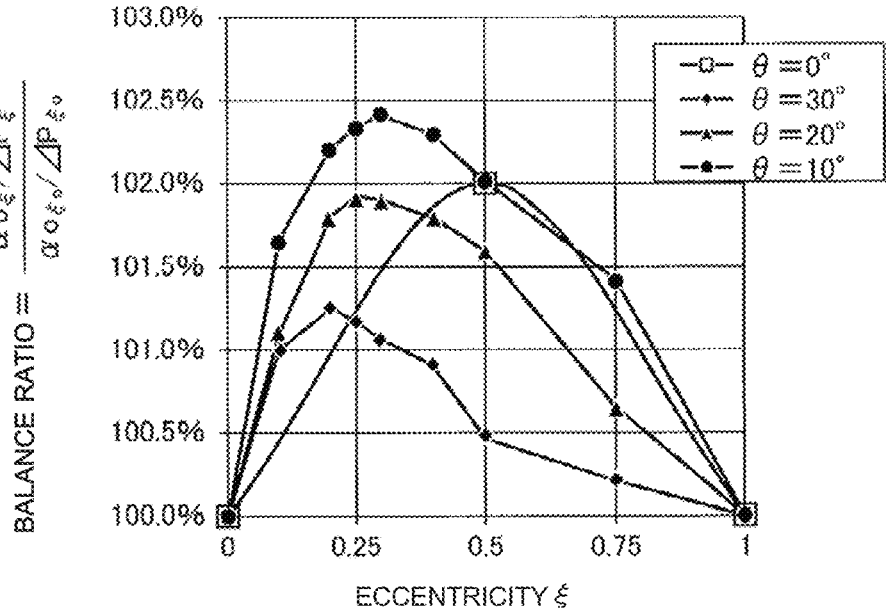
FIG. 18 is a graph for showing a relationship between an eccentricity and a balance ratio of the flat tube in Embodiment 1 and Embodiment 2.

FIG. 18 is a graph for showing a relationship between an eccentricity $\xi$ and a balance ratio of the flat tube in Embodiment 1 and Embodiment 2.

In FIG. 18, the balance ratio $(\alpha 0\xi/\Delta P\xi)/(\alpha 0\xi 0/\Delta P\xi 0)$ is plotted with changes in eccentricity $\xi$ at intervals of 10 degrees to the inclination angles $\theta 1=\theta 2=0°$ to 30° of the first flat tube 11 and the second flat tube 21.

The balance ratio is a ratio of a value obtained by dividing the heat transfer rate $\alpha$ by the pressure loss $\Delta P$, and has a reference at the eccentricity $\xi=0$ as a denominator (when the first flat tube 11 and the second flat tube 21 overlap on the same plane).

Accordingly, as shown in FIG. 18, it can be seen that, as the inclination angles $\theta 1$ and $\theta 2$ of the first flat tube 11 and the second flat tube 21 become larger, a value of the eccentricity $\xi$ with the maximum balance ratio becomes smaller. This is because the degree of drift in the first heat transfer portion 100 becomes larger as the inclination angles $\theta 1$ and $\theta 2$ become larger.

Further, it can also be seen that the maximum value of the balance ratio becomes larger as the inclination angles $\theta 1$ and $\theta 2$ become smaller. This is because the degree of drift in the first heat transfer portion 100 becomes smaller as the inclination angles $\theta$ are smaller, and the pressure loss $\Delta P$ becomes smaller.

Figure 19:
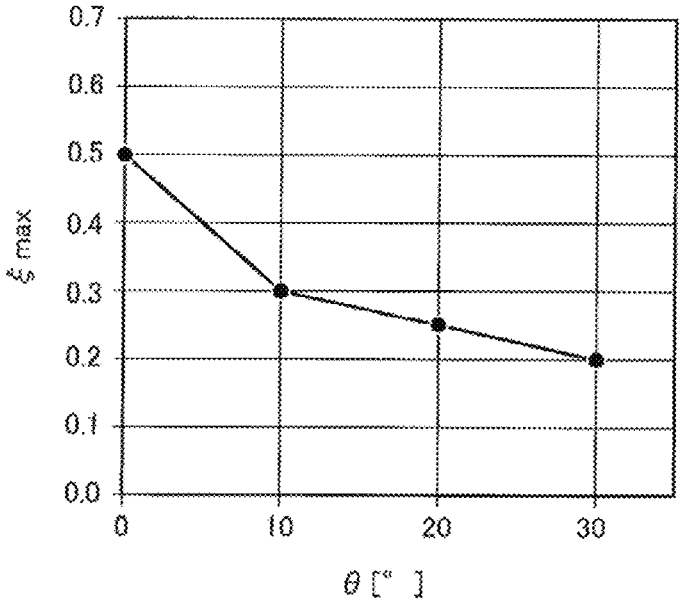
FIG. 19 is a graph for showing a relationship between the inclination angle θ and ξmax of the flat tube in Embodiment 1 and Embodiment 2.

FIG. 19 is a graph for showing a relationship between the inclination angle $\theta$ and $\xi max$ of the flat tube in Embodiment 1 and Embodiment 2.

In the graph of FIG. 19, a vertical axis represents an eccentricity $\xi$ ($\xi max$) which is given when the balance ratio has a maximum value in FIG. 18, and a horizontal axis represents the inclination angles $\theta$ which are set to $\theta=\theta 1=\theta 2$. When the inclination angle $\theta=0$ is given, there is no drift in the first heat transfer portion 100, and hence $\xi max=0.5$ is given. It can be recognized that the $\xi max$ decreases as the inclination angle $\theta$ increases. That is, an optimum eccentricity $\xi$ with a maximum balance ratio in accordance with the inclination angle $\theta$ is present for each inclination angle $\theta$.

Thus, through adjustment of the eccentricity $\xi$ by the inclination angles $\theta 1$ and $\theta 2$ of the first flat tube 11 and the second flat tube 21, the heat exchanger 1 having an optimum value of the balance ratio between the heat transfer rate $\alpha$ and the pressure loss $\Delta P$ can be obtained.

A heat exchanger (1) of Embodiment 1 and Embodiment 3 includes: a first heat transfer portion 100 including a plurality of first flat tubes 11 arranged at equal intervals and spaced apart from each other by a distance Dp in a gravity direction; and a second heat transfer portion 200 positioned downstream of the first heat transfer portion 100 in a flow direction of a heat exchange medium perpendicular to the gravity direction, the second heat transfer portion 200 including a plurality of second flat tubes 21 arranged at equal intervals and spaced apart from each other by the distance Dp in the gravity direction, in which: the plurality of first flat tubes 11 are each arranged with inclination such that an angle formed between a first cross-sectional center plane CA1 and the flow direction is an angle $\theta 1$, the first cross-sectional center plane CA1 being an imaginary plane passing through the center of a direction of short-axis of a flow passage cross section, and that a front edge portion (first arcuate portion 11*d*) in the flow direction is below a rear edge portion (second arcuate portion 11*e*) in the flow direction; the plurality of second flat tubes 21 each have a front-most edge line 21*g* being an intersecting line between a second cross-sectional center plane CA2 and an end portion on upstream in the flow direction, the second cross-sectional center plane CA2 being an imaginary plane passing through the center of a direction of short-axis of a flow passage cross section; a pair of the front-most edge lines 21*g* adjacent to each other include a first front-most edge line 21*g*−1 positioned on an upper side in the gravity direction and a second front-most edge line 21*g*−2 positioned on a lower side in the gravity direction; the first front-most edge line 21*g*−1 and the first cross-sectional center plane CA1, which is positioned between the first front-most edge line 21*g*−1 and the second front-most edge line 21*g*−2, are arranged to be spaced apart from each other by a distance W; and the distance W is set so as to satisfy $W=\xi\times Dp\times\cos\theta 1$ where $0\leq\xi<0.5$.

Accordingly, as illustrated in FIG. 6, the second flat tubes 21 are arranged in conformity with drift of air in the first heat transfer portion 100, and hence the air speed on an upper side of the second flat tube 21 increases as compared to Comparative Example 1 of FIG. 5. That is, the high air speed region is formed on both of the upper and lower surfaces of the second flat tube 21 as originally intended for the staggered arrangement of the flat tubes, thereby being capable of improving the heat transfer performance. Further, the drainage performance can be improved by inclination of the first flat tubes 11 and the second flat tubes 21.

Further, in the heat exchanger (2) of the above-mentioned item (1): the plurality of second flat tubes 21 are arranged with inclination such that an angle formed between the second cross-sectional center plane CA2 and the flow direction of the heat exchange fluid is an angle $\theta 2$, and that a front edge portion in the flow direction is below a rear edge portion in the flow direction; and the angle $\theta 1$ and the angle $\theta 2$ are equal to each other.

Accordingly, the first flat tubes 11 and the second flat tubes 21 are inclined at equal angles and in the same direction, thereby being capable of suppressing the flow passage resistance of the heat exchange fluid and reducing the manufacturing cost.

Further, in the heat exchanger (3) of the above-mentioned item (1): the plurality of second flat tubes 21 are arranged with inclination such that an angle formed between the second cross-sectional center plane CA2 and the flow direction of the heat exchange fluid is an angle $\theta 2$, and that a front edge portion in the flow direction is below a rear edge portion in the flow direction; and the angle $\theta 1$ is larger than the angle $\theta 2$.

Accordingly, as illustrated in FIG. 15, the inflow angle of air which flows into the second flat tube 21 at an angle smaller than the inclination angle $\theta 1$ of the first flat tube 11 can be matched with the inclination angle $\theta 2$ of the second flat tube 21.

Therefore, it is possible to obtain the heat exchanger 1 with high heat exchange efficiency, which suppresses pressure loss by smoothing the flow at the front edge portion (first arcuate portion 21*d*) of the second flat tube 21 and suppresses deviation in air speed on the upper and lower surfaces of the second flat tube 21.

Further, in the heat exchanger (4) of the above-mentioned items (1) to (3): the first heat transfer portion 100 includes a plurality of first fins 10 intersecting with the plurality of first flat tubes 11; the second heat transfer portion 200 includes a plurality of second fins 20 intersecting with the plurality of second flat tubes 21; the plurality of first fins 10 each have a plurality of first cutout portions 12 for fixing the plurality of first flat tubes 11, and the plurality of first cutout portions 12 are each opened on downstream in the flow direction of the heat exchange fluid; and the plurality of second fins 20 each have a plurality of second cutout portions 22 for fixing the plurality of second flat tubes 21, and the plurality of second cutout portions 22 are each opened on downstream in the flow direction of the heat exchange fluid.

Accordingly, the drainage regions 14 and 24 are arranged on a windward side, and the cutout regions 13 and 23 are arranged on a leeward side. The drainage regions 14 and 24 are arranged farther from the first flat tubes 11 and the second flat tubes 21 as compared to the cutout regions 13 and 23. Therefore, when the heat exchanger 1 is used as an evaporator, the surface temperature in the drainage regions 14 and 24 are above that in the cutout regions 13 and 23. Thus, in the heat exchanger 1 according to Embodiment 1 in which the drainage regions 14 and 24 are arranged on the windward side, an effect of suppressing the amount of frost formation can be achieved, thereby being capable of suppressing the defrosting mode operation time.

Further, a heat exchanger (5) of Embodiment 2 include: a first heat transfer portion 100 including a plurality of first flat tubes 11 arranged at equal intervals and spaced apart from each other by a distance Dp in a gravity direction; and a second heat transfer portion 200 positioned downstream of the first heat transfer portion 100 in a flow direction of a heat exchange medium perpendicular to the gravity direction, the second heat transfer portion 200 including a plurality of second flat tubes 21 arranged at equal intervals and spaced apart from each other by the distance Dp in the gravity direction, in which: the plurality of first flat tubes 11 are each arranged with inclination such that an angle formed between a first cross-sectional center plane CA1 and the flow direction is an angle θ1, the first cross-sectional center plane CA1 being an imaginary plane passing through the center of a short-axis direction of a flow passage cross section, and that a front edge portion (first arcuate portion 11*d*) in the flow direction is above a rear edge portion (second arcuate portion 11*e*) in the flow direction; the plurality of second flat tubes 21 each have a front-most edge line 21*g* being an intersecting line between a second cross-sectional center plane CA2 and an end portion on upstream in the flow direction, the second cross-sectional center plane CA2 being an imaginary plane passing through the center of a short-axis direction of a flow passage cross section; a pair of the front-most edge lines 21*g* adjacent to each other include a first front-most edge line 21*g*−1 positioned on an upper side in the gravity direction and a second front-most edge line 21*g*−2 positioned on a lower side in the gravity direction; the second front-most edge line 21*g*−2 and the first cross-sectional center plane CA1 positioned between the first front-most edge line 21*g*−1 and the second front-most edge line 21*g*−2 are arranged to be spaced apart from each other by a distance W; and the distance W is set so as to satisfy $W=\xi\times Dp\times\cos\theta1$ where $0\leq\xi<0.5$.

Accordingly, as illustrated in FIG. 12, the second flat tubes 21 are arranged in conformity with drift of air in the first heat transfer portion 100, and hence the air speed on a lower side of the second flat tube 21 increases as compared to Comparative Example 2 of FIG. 11. That is, the high air speed region is formed on both the upper and lower surfaces of the second flat tube 21 as originally intended for the staggered arrangement of the flat tubes, thereby being capable of improving the heat transfer performance. Further, the drainage performance can be improved by inclination of the first flat tubes 11 and the second flat tubes 21.

Further, in the heat exchanger (6) of the above-mentioned item (5): the plurality of second flat tubes 21 are arranged with inclination such that an angle formed between the second cross-sectional center plane CA2 and the flow direction of the heat exchange medium is an angle θ2, and that a front edge portion in the flow direction is above a rear edge portion in the flow direction; and the angle θ1 and the angle θ2 are equal to each other.

Accordingly, the first flat tubes 11 and the second flat tubes 21 are inclined at equal angles and in the same direction, thereby being capable of suppressing the flow passage resistance of the heat exchange fluid and reducing the manufacturing cost.

Further, in the heat exchanger (7) of the above-mentioned item (5): the plurality of second flat tubes 21 are arranged with inclination such that an angle formed between the second cross-sectional center plane CA2 and the flow direction of the heat exchange fluid is an angle θ2, and that a front edge portion in the flow direction is above a rear edge portion in the flow direction; and the angle θ1 is larger than the angle θ2.

Accordingly, as illustrated in FIG. 12, the inflow angle of air which flows into the second flat tube 21 at an angle smaller than the inclination angle θ1 of the first flat tube 11 can be matched with the inclination angle θ2 of the second flat tube 21.

Therefore, it is possible to obtain the heat exchanger 1 with high heat exchange efficiency, which suppresses pressure loss by smoothing the flow at the front edge portion (first arcuate portion 21*d*) of the second flat tube 21 and suppresses deviation in air speed on the upper and lower surfaces of the second flat tube 21.

Further, in the heat exchanger (8) of the above-mentioned items (5) to (7): the first heat transfer portion 100 includes a plurality of first fines 10 which intersect with the plurality of first flat tubes 11; the second heat transfer portion 200 includes a plurality of second fins 20 which intersect with the plurality of the second flat tubes 21; the plurality of first fins 10 each have a plurality of first cutout portions 12 for fixing the plurality of first flat tubes 11, and the plurality of first cutout portions are each opened on upstream in the flow direction; and the plurality of second fins 20 each have a plurality of second cutout portions 22 for fixing the plurality of second flat tubes 21, and the plurality of second cutout portions 22 are each opened on upstream in the flow direction.

Accordingly, the drainage regions 14 and 24 can be arranged on the leeward side. Therefore, water droplets can be introduced to the drainage regions 14 and 24 with use of an airflow during the defrosting mode operation. With this configuration, the drainage performance is improved, thereby being capable of suppressing the defrosting mode operation time.

Further, in the heat exchanger (9) of the above-mentioned items (1) to (8), the angle θ1 is equal to or smaller than 20 degrees.

Accordingly, the drainage performance of the first flat tube 11 can be secured, thereby being capable of reducing the pressure loss when the heat exchange fluid passes.

The invention claimed is:

1. A heat exchanger, comprising:

a first heat transfer portion including a plurality of first flat tubes arranged at equal intervals and spaced apart from each other by a distance Dp in a gravity direction; and a second heat transfer portion positioned downstream of the first heat transfer portion in a flow direction of a heat exchange medium perpendicular to the gravity direction, the second heat transfer portion including a plurality of second flat tubes arranged at equal intervals and spaced apart from each other by the distance Dp in the gravity direction, wherein the plurality of first flat tubes each have a pair of surface portions facing each other in a direction of a short-axis of a flow-passage cross-section of each of the first flat tubes, the pair of surface portions each having a flat shape, are each arranged with inclination such that an angle formed between a first cross-sectional center plane and the flow direction is an angle θ1, the first cross-sectional center plane being an imaginary plane of a flow passage of the first flat tube, the imaginary plane passing through a center in the direction of short-axis of the flow passage cross section, and that a front edge portion in the flow direction is below a rear edge portion in the flow direction, wherein the plurality of second flat tubes each have a pair of surface portions facing each other in a direction of a short-axis of a flow-passage cross section of each of the second flat tubes, the pair of surface portions each having a flat shape, each have a front-most edge line being an intersecting line between a second cross-sectional center plane and an end portion on upstream in the flow direction, the second cross-sectional center plane being an imaginary plane of a flow passage of the second flat tube, the imaginary plane passing through a center in the direction of short-axis of a flow passage cross section, wherein adjacent ones of the front-most edge lines include a first front-most edge line positioned on an upper side in the gravity direction and a second front-most edge line positioned on a lower side in the gravity direction, wherein the first front-most edge line and the first cross-sectional center plane positioned between the first front-most edge line and the second front-most edge line are arranged to be spaced apart from each other by a distance W, wherein the distance W satisfies the following formula:

$$W=\xi\times Dp\times\cos\theta 1 \text{ where } 0\leq\xi<0.5.$$

2. The heat exchanger of claim 1, wherein the plurality of second flat tubes are arranged with inclination such that an angle formed between the second cross-sectional center plane and the flow direction is an angle θ2, and that a front edge portion in the flow direction is below a rear edge portion in the flow direction, and wherein the angle θ1 and the angle θ2 are equal to each other.

3. The heat exchanger of claim 1, wherein the plurality of second flat tubes are arranged with inclination such that an angle formed between the second cross-sectional center plane and the flow direction is an angle θ2, and that a front edge portion in the flow direction is below a rear edge portion in the flow direction, and wherein the angle θ1 is larger than the angle θ2.

4. The heat exchanger of claim 1, wherein the first heat transfer portion includes a plurality of first fins intersecting with the plurality of first flat tubes, wherein the second heat transfer portion includes a plurality of second fins intersecting with the plurality of second flat tubes, wherein the plurality of first fins each have a plurality of first cutout portions for fixing the plurality of first flat tubes, and the plurality of first cutout portions are each opened on downstream in the flow direction, and wherein the plurality of second fins each have a plurality of second cutout portions for fixing the plurality of second flat tubes, and the plurality of second cutout portions are each opened on downstream in the flow direction.

5. The heat exchanger of claim 1, wherein the angle θ1 is equal to or smaller than 20 degrees.

6. A heat exchanger, comprising:

a first heat transfer portion including a plurality of first flat tubes arranged at equal intervals and spaced apart from each other by a distance Dp in a gravity direction; and a second heat transfer portion positioned downstream of the first heat transfer portion in a flow direction of a heat exchange medium perpendicular to the gravity direction, the second heat transfer portion including a plurality of second flat tubes arranged at equal intervals and spaced apart from each other by the distance Dp in the gravity direction, wherein the plurality of first flat tubes each have a pair of surface portions facing each other in a direction of a short-axis of a flow-passage cross section of each of the first flat tubes, the pair of surface portions each having a flat shape, are each arranged with inclination such that an angle formed between a first cross-sectional center plane and the flow direction is an angle θ1, the first cross-sectional center plane being an imaginary plane of a flow passage of the first flat tube, the imaginary plane passing through a center in the direction of short-axis of the flow passage cross section, and that a front edge portion in the flow direction is above a rear edge portion in the flow direction, wherein the plurality of second flat tubes each have a pair of surface portions facing each other in a direction of a short-axis of a flow-passage cross section of each of the second flat tubes, the pair of surface portions each having a flat shape, and each have a front-most edge line being an intersecting line between a second cross-sectional center plane and an end portion on upstream in the flow direction, the second cross-sectional center plane being an imaginary plane of a flow passage of the second flat tube, the imaginary plane passing through a center in the direction of short-axis of the flow passage cross section, wherein adjacent ones of the front-most edge lines include a first front-most edge line positioned on an upper side in the gravity direction and a second front-most edge line positioned on a lower side in the gravity direction, wherein the second front-most edge line and the first cross-sectional center plane positioned between the first front-most edge line and the second front-most edge line are arranged to be spaced apart from each other by a distance W, and wherein the distance W satisfies the following formula:

$$W=\xi\times Dp\times\cos\theta 1 \text{ where } 0\leq\xi<0.5.$$

7. The heat exchanger of claim 6, wherein the plurality of second flat tubes are arranged with inclination such that an angle formed between the second cross-sectional center plane and the flow direction is an angle θ2, and that a front edge portion in the flow direction is above a rear edge portion in the flow direction, and wherein the angle θ1 and the angle θ2 are equal to each other.

8. The heat exchanger of claim 6, wherein the plurality of second flat tubes are arranged with inclination such that an angle formed between the second cross-sectional center plane and the flow direction is an angle θ2, and that a front edge portion in the flow direction is above a rear edge portion in the flow direction, and wherein the angle θ1 is larger than the angle θ2.

9. The heat exchanger of claim 6, wherein the first heat transfer portion includes a plurality of first fins intersecting with the plurality of first flat tubes, wherein the second heat transfer portion includes a plurality of second fins intersecting with the plurality of second flat tubes, wherein the plurality of first fins each have a plurality of first cutout portions for fixing the plurality of first flat tubes, and the plurality of first cutout portions are each opened on upstream in the flow direction, and wherein the plurality of second fins each have a plurality of second cutout portions for fixing the plurality of second flat tubes, and the plurality of second cutout portions are each opened on upstream in the flow direction.

10. The heat exchanger of claim 6, wherein the angle θ1 is equal to or smaller than 20 degrees.

* * * * *